US010544532B2

(12) United States Patent
Choi et al.

(10) Patent No.: US 10,544,532 B2
(45) Date of Patent: Jan. 28, 2020

(54) LAUNDRY TREATMENT APPARATUS AND METHOD OF CONTROLLING THE SAME

(71) Applicant: LG ELECTRONICS INC., Seoul (KR)

(72) Inventors: Kihoon Choi, Seoul (KR); Junho Lee, Seoul (KR); Seongmin Jang, Seoul (KR); Jonghwan Lee, Seoul (KR); Woonghui Won, Seoul (KR); Jongseok Jung, Seoul (KR); Sangwook Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/617,808

(22) Filed: Jun. 8, 2017

(65) Prior Publication Data

US 2017/0356115 A1 Dec. 14, 2017

Related U.S. Application Data

(60) Provisional application No. 62/420,575, filed on Nov. 11, 2016.

(30) Foreign Application Priority Data

Jun. 8, 2016 (KR) ..... 10-2016-0071300
Jun. 8, 2016 (KR) ..... 10-2016-0071301
Jun. 8, 2016 (KR) ..... 10-2016-0071302

(51) Int. Cl.

| | |
|---|---|
| ***D06F 33/02*** | (2006.01) |
| ***D06F 29/02*** | (2006.01) |
| D06F 37/04 | (2006.01) |
| ***D06F 37/12*** | (2006.01) |
| ***D06F 37/22*** | (2006.01) |
| ***D06F 37/26*** | (2006.01) |

(Continued)

(52) U.S. Cl.
CPC ..... *D06F 33/02* (2013.01); *D06F 29/02* (2013.01); *D06F 37/04* (2013.01); *D06F 37/12* (2013.01);

(Continued)

(58) Field of Classification Search
CPC ..... D06F 33/02
See application file for complete search history.

(56) References Cited

U.S. PATENT DOCUMENTS

| | | | |
|---|---|---|---|
| 5,890,247 | A | 4/1999 | Erickson et al. |
| 2011/0265524 | A1 | 11/2011 | Kim et al. |
| 2015/0376828 | A1 | 12/2015 | Seo et al. |

FOREIGN PATENT DOCUMENTS

| | | |
|---|---|---|
| CN | 1858329 | 11/2006 |
| CN | 101135099 | 3/2008 |

(Continued)

OTHER PUBLICATIONS

Extended European Search Report in European Application No. 17175073.0, dated Sep. 22, 2017, 10 pages (with English translation).

(Continued)

*Primary Examiner* — Jason Y Ko
(74) *Attorney, Agent, or Firm* — Fish & Richardson P.C.

(57) ABSTRACT

A method of controlling a laundry treatment apparatus, the method including: determining whether bubbles have been generated in a tub of the laundry treatment apparatus in a state in which a second washing apparatus of the laundry treatment apparatus is operated based on a sequence of operations; and based on a determination that bubbles have been generated, reducing bubbles by (i) adding at least one first operation to the sequence of operations or (ii) replacing at least one second operation of the sequence of operations, is disclosed.

18 Claims, 16 Drawing Sheets

(51) Int. Cl.

| | |
|---|---|
| ***D06F 37/30*** | (2006.01) |
| ***D06F 37/36*** | (2006.01) |
| ***D06F 39/00*** | (2006.01) |
| ***D06F 39/02*** | (2006.01) |
| ***D06F 39/04*** | (2006.01) |
| ***D06F 39/08*** | (2006.01) |
| ***D06F 39/14*** | (2006.01) |
| *D06F 35/00* | (2006.01) |
| *D06F 58/02* | (2006.01) |

(52) U.S. Cl.

CPC ..... *D06F 37/22* (2013.01); *D06F 37/266* (2013.01); *D06F 37/304* (2013.01); *D06F 37/36* (2013.01); *D06F 39/003* (2013.01); *D06F 39/005* (2013.01); *D06F 39/02* (2013.01); *D06F 39/045* (2013.01); *D06F 39/085* (2013.01); *D06F 39/087* (2013.01); *D06F 39/088* (2013.01); *D06F 39/14* (2013.01); *D06F 35/005* (2013.01); *D06F 58/02* (2013.01); *D06F 2202/10* (2013.01); *D06F 2202/12* (2013.01); *D06F 2204/06* (2013.01); *D06F 2204/084* (2013.01); *D06F 2204/086* (2013.01)

(56) References Cited

FOREIGN PATENT DOCUMENTS

| | | |
|---|---|---|
| CN | 101307551 | 11/2008 |
| CN | 102844486 | 12/2012 |
| CN | 204343050 | 5/2015 |
| CN | 104762789 | 7/2015 |
| CN | 105297348 | 2/2016 |
| CN | 105316900 | 2/2016 |
| DE | 102009027933 | 1/2011 |
| EP | 2849008 | 3/2015 |
| EP | 3235939 | 10/2017 |
| JP | 2005169001 | 6/2005 |
| JP | 2013090736 | 5/2013 |
| WO | 2007074037 | 7/2007 |
| WO | WO 2015036336 | 3/2015 |

OTHER PUBLICATIONS

European Office Action in European Application No. 17175073.0, dated Jul. 11 2018, 4 pages.

Australian Office Action in Australian Application No. 2017203834, dated Nov. 2, 2018, 7 pages.

Chinese Office Action in Chinese Appln. No. 201710428121.X, dated Jan. 29, 2019, 23 pages (with English translation).

(a)

(b)

(a)

(b)

LAUNDRY TREATMENT APPARATUS AND METHOD OF CONTROLLING THE SAME

CROSS-REFERENCE TO RELATED APPLICATIONS

This application claims the benefit of Korean Patent Application No. 10-2016-0071300, filed on Jun. 8, 2016, Korean Patent Application No. 10-2016-0071301, filed on Jun. 8, 2016, Korean Patent Application No. 10-2016-0071302, filed on Jun. 8, 2016 and U.S. Provisional Patent Application No. 62/420,575, filed on Nov. 11, 2016, the contents of which are incorporated by reference herein in their entireties.

TECHNICAL FIELD

The present application relates to a laundry treatment apparatus and a method of controlling the same.

BACKGROUND

Generally, a laundry treatment apparatus is a concept including an apparatus that is capable of washing laundry (objects to be washed), an apparatus that is capable of drying laundry (objects to be dried), and an apparatus that is capable of washing and drying laundry.

Conventional laundry treatment apparatuses are classified into a front loading type laundry treatment apparatus, into which laundry is introduced through an introduction port provided in the front thereof, and a top loading type laundry treatment apparatus, into which laundry is introduced through an introduction port provided in the top thereof.

The top loading type laundry treatment apparatus includes a tub having an introduction port provided in the top thereof, a drum rotatably provided in the tub, and a door for opening and closing the introduction port.

In general, a single large-capacity laundry treatment apparatus is used in each home. When laundry is to be sorted into respective kinds for washing, therefore, the laundry treatment apparatus must be used several times. For example, when laundry, such as adult clothes, and laundry, such as underwear or baby clothes, are to be separately washed, the laundry treatment apparatus is used to wash the former kind of laundry, and then the laundry treatment apparatus is used to wash the latter kind of laundry. As a result, washing time is increased, and power consumption is also increased.

In addition, using a conventional large-sized laundry treatment apparatus to wash a small amount of laundry is not preferable in terms of energy savings. Since a washing course set in the large-sized laundry treatment apparatus is generally used to wash a large amount of laundry, water consumption is high. Furthermore, power consumption to rotate a large-sized drum or inner tub is also high. In addition, since the washing course is used to wash a large amount of laundry, the washing time is relatively long. Furthermore, since the washing course set in the large-sized laundry treatment apparatus is mainly used for general clothes, the large-sized laundry treatment apparatus may not be suitable for washing delicate clothes, such as underwear or baby clothes.

The large-sized laundry treatment apparatus is also not suitable for frequently washing small amounts of laundry. Consumers tend to gather laundry for several days or more in order to wash laundry at once.

If underwear or baby clothes remain unwashed for a long time, it is not sanitary. If such laundry remains unwashed for a long time, dirt may become more strongly adhered to the laundry, with the result that the laundry may not be thoroughly washed. For the above reasons, a small-sized laundry treatment apparatus having a smaller capacity than the large-sized laundry treatment apparatus is required.

If two small-sized laundry treatment apparatuses are installed side by side in each home, however, it is not preferable in terms of space utilization or the external appearance thereof In recent years, there has been proposed a combination-type laundry treatment apparatus including both a front loading type laundry treatment apparatus and a top loading type laundry treatment apparatus in order to solve the above problem.

The top loading type laundry treatment apparatus is provided on or under the front loading type laundry treatment apparatus in order to wash a small amount of laundry, thereby improving space utilization.

The height of the top loading type laundry treatment apparatus, which is an auxiliary laundry treatment apparatus, is limited. If the top loading type laundry treatment apparatus is high, the washing capacity of the apparatus is increased. In this case, however, it may be difficult for a user to access the top loading type laundry treatment apparatus, since the top loading type laundry treatment apparatus is provided on the front loading type laundry treatment apparatus. For this reason, it is preferable to configure the top loading type laundry treatment apparatus such that the top loading type laundry treatment apparatus is lower than conventional top loading type laundry treatment apparatuses.

The laundry treatment apparatus, particularly the top loading type laundry treatment apparatus, which has a relatively small capacity, is characterized in that the distance between the introduction port and the upper end of the drum is very small. For this reason, foreign matter generated in the tub when the drum is rotated to wash laundry may remain on the door.

In addition, some laundry treatment apparatuses are configured such that the height of the tub is smaller than the diameter of the tub. In this case, a large amount of bubbles are generated in the tub during the rotation of the drum.

SUMMARY

In general, one innovative aspect of the subject matter described in this specification can be implemented in a method of controlling a laundry treatment apparatus that includes a cabinet including a first opening and a second opening, a first cabinet door that is coupled to the cabinet and that is configured to open or close the first opening, a second cabinet door that is coupled to the cabinet and that is configured to open or close the second opening, a first washing apparatus that is located in the cabinet and that is configured to treat laundry introduced into an interior area of the first washing apparatus through the first cabinet door in a first direction, and a second washing apparatus that is configured to treat laundry introduced into an interior area of the second washing apparatus through the second cabinet door in a second direction, the second washing apparatus including a tub that is accessible through the second opening in a state in which the second cabinet door is opened, that is configured to store water, and that includes a tub opening at a top of the tub, a tub cover that is coupled to the tub, that covers the tub opening, and that includes an introduction port through which laundry is introduced into the interior area of the second washing apparatus, a tub door that is coupled to the tub cover, that is configured to open or close the introduction port, and that is independently operated of the second cabinet door, a drum that is located in the tub and that is configured to rotate about a shaft, the shaft extending in the second direction, and a controller that is configured to control operations of the second washing apparatus, wherein the method comprises: determining whether bubbles have been generated in the tub in a state in which the second washing apparatus is operated based on a sequence of operations; and based on a determination that bubbles have been generated, reducing bubbles by (i) adding at least one first operation to the sequence of operations or (ii) replacing at least one second operation of the sequence of operations.

The foregoing and other implementations can each optionally include one or more of the following features, alone or in combination. In particular, one implementation includes all the following features in combination. The method further includes controlling, by the controller, the second washing apparatus to: based on the sequence of operations, operate in a washing cycle, a rinsing cycle, and a spin-drying cycle in order, and in a state in which bubbles are generated in the tub, reduce bubbles by (i) adding the at least one first operation to the sequence of operations or (ii) replacing the at least one second operation of the sequence of operations. The method further includes: in the state in which bubbles are generated in the tub, reducing bubbles by controlling the second washing apparatus to reduce bubbles in the washing cycle, and controlling the drum to operate at a first rpm to perform washing in the washing cycle. The method further includes: controlling the drum to operate at a second rpm that is lower than the first rpm to reduce bubbles in the washing cycle. In a state in which the drum rotates in a first direction at the first rpm, wash water in the tub moves upwardly along an inner circumferential surface of the tub and is introduced into the tub through the introduction port. In a state in which the drum operates at the second rpm, wash water in the tub does not move. The method further includes determining whether bubbles have been generated based on a difference between a level of wash water in the tub in a state in which the drum operates at the first rpm and a reference level of wash water in the tub. The method further includes: controlling the second washing apparatus to operate in the washing cycle for a first time period based on a determination that bubbles have been generated, and controlling the second washing apparatus to operate in the washing cycle for a second time period based on a determination that bubbles have not been generated, wherein the first time period is longer than the second time period. The method further includes controlling, in the rinsing cycle by the controller, the second washing apparatus to: drain wash water from the tub, intermittently spin the drum to dry laundry using centrifugal force generated by rotation of the drum, supply wash water into the tub, and rinse laundry. In the state in which bubbles are generated in the tub, reducing bubbles further comprises: performing, in the state in which bubbles are generated in the washing cycle, at least one operation directed to reducing bubbles after draining wash water from the tub before spinning the drum to dry laundry. Performing the at least one operation directed to reducing bubbles includes a bubble reduction pattern comprising: supplying water, draining water, and rotating the drum simultaneously. The bubble reduction pattern further includes: waiting, for a third time period, to stop supplying water, draining water, and rotating the drum, and draining water. The method further includes: repeating the bubble reduction pattern. Performing the at least one operation directed to reducing bubbles includes a rinsing pattern comprising: supplying water, rotating the drum, and draining water sequentially. The method further includes: performing the bubble reduction pattern before and after the rinsing pattern. The method further includes: completing the at least one operation directed to reducing bubbles after the rinsing pattern and the bubble reduction pattern are sequentially performed. The method further includes: controlling the drum to operate at a third rpm to rinse laundry, wherein, in a state in which the drum operates at the third rpm, wash water in the tub moves upwardly along an inner circumferential surface of the tub and is introduced into the tub through the introduction port to wash a lower surface of the tub door. The rinsing cycle includes: draining wash water from the tub, intermittently spinning the drum to dry laundry using centrifugal force generated by rotation of the drum, supplying wash water into the tub, and rinsing laundry, and wherein determining whether bubbles have been generated in the tub is performed during intermittently spinning the drum to dry laundry. The method further includes performing, based on a determination that bubbles have been generated, a bubble removal pattern after intermittently spinning the drum, and wherein the bubble removal pattern includes: supplying water, draining water, and rotating the drum simultaneously. Determining whether bubbles have been generated in the tub comprises determining whether bubbles have been generated based on a value of current measured in a motor to drive the drum during intermittently spinning the drum.

The subject matter described in this specification can be implemented in particular examples so as to realize one or more of the following advantages. Comparing to a conventional laundry treatment apparatus, a laundry treatment apparatus can sense bubbles generated in a tub and prevent bubbles from being generated. In particular, the laundry treatment apparatus can reduce or remove bubbles in the tub.

The details of one or more examples of the subject matter described in this specification are set forth in the accompanying drawings and the description below. Other potential features, aspects, and advantages of the subject matter will become apparent from the description, the drawings, and the claim.

BRIEF DESCRIPTION OF THE DRAWINGS

Like reference numbers and designations in the various drawings indicate like elements.

DETAILED DESCRIPTION

Figure 1:
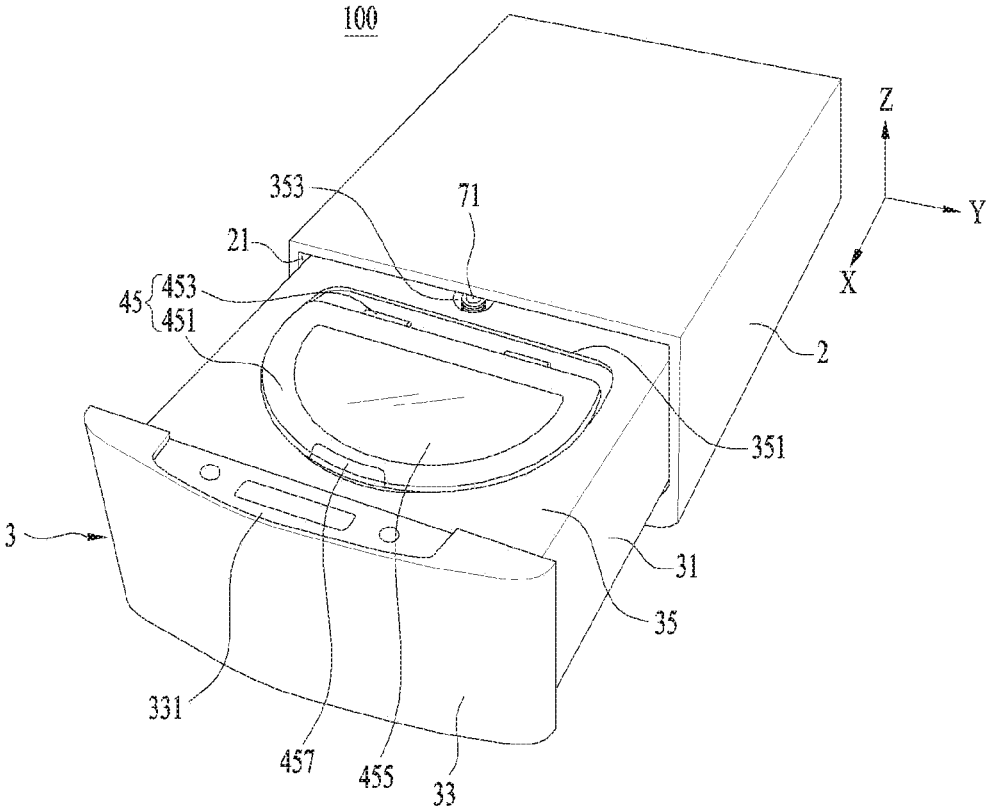
FIGS. 1 and 2 are diagrams illustrating an example laundry treatment apparatus.
Figure 2:
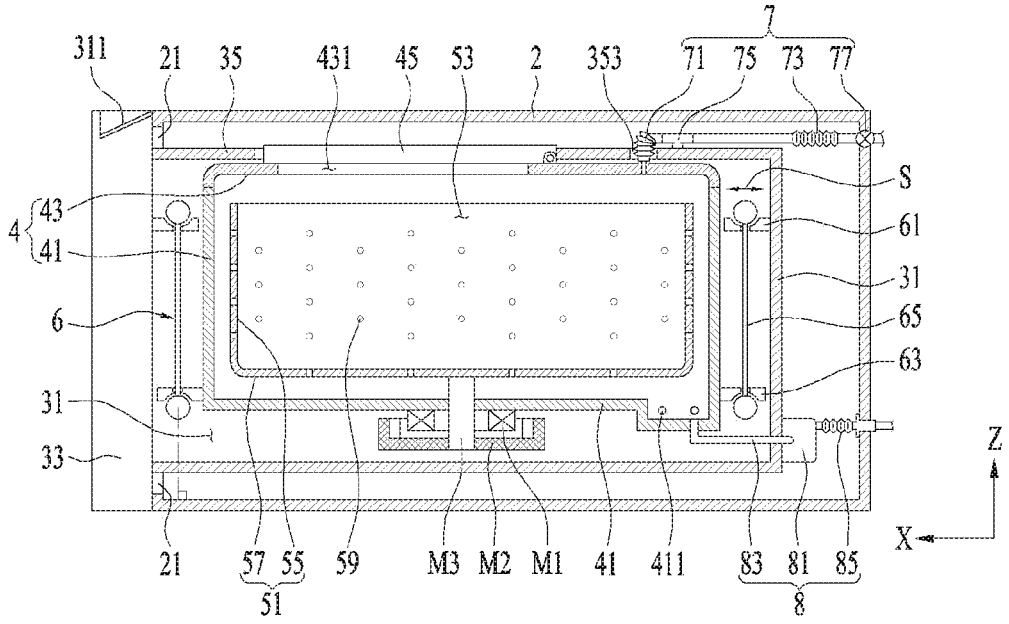

FIGS. 1 and 2 illustrate an example laundry treatment apparatus.

As shown in FIGS. 1 and 2, an example of a laundry treatment apparatus is a small-sized top loader. The example laundry treatment apparatus can be a small-sized top loader. The laundry treatment apparatus, e.g., a small-sized washer can be used together with a washer or a dryer.

The laundry treatment apparatus may be located on a washer or a dryer, or may be located under the washer or the dryer. Of course, the laundry treatment apparatus may be provided together with a general washer or dryer in a single cabinet. Consequently, the volume or height of the laundry treatment apparatus may be smaller than that of the washer or the dryer.

Specifically, a laundry treatment apparatus 100 may include a cabinet 2, a drawer 3 configured to be withdrawn from the cabinet, a tub 3 provided in the drawer for storing water, and a drum 5 rotatably provided in the tub for receiving laundry.

The cabinet 2 may be configured to define the external appearance of the laundry treatment apparatus. Alternatively, the cabinet 2 may be simply configured as space for receiving the drawer 3. In any case, the cabinet 2 may be provided at the front surface thereof with an open surface 21, through which the drawer 2 is inserted.

The drawer 3 includes a drawer body 31 configured to be inserted into the cabinet 2 through the open surface 21, a drawer panel 33 fixed to the front surface of the drawer body 31 for opening and closing the opening surface 21, and a drawer cover 35 configured to define the upper surface of the drawer body 31.

The drawer panel 33 may also serve as a handle for withdrawing the drawer body 31 from the cabinet 2, since the drawer panel 33 is fixed to the front surface of the drawer body 31.

The drawer panel 33 may be provided with a control panel 331 for allowing a user to input a control command related to the operation of the laundry treatment apparatus 100 and for displaying a message related to the operation of the laundry treatment apparatus to the user.

The drawer body 31 may be inserted into the cabinet 2 through the open surface 21. The shape of the drawer body 31 is not particularly restricted, as long as the drawer body 31 provides space for receiving the tub 4. FIG. 1 shows a drawer body 31 formed in an empty hexahedral shape by way of example.

The drawer cover 35 is provided with a first through hole 351 and a second through hole 353, through which the inside and outside of the drawer body 31 communicate with each other. The first through hole 351 is provided to introduce laundry, and the second through hole 353 is provided to supply water necessary to wash the laundry, which will be described in detail later.

As shown in FIG. 2, the tub 4 includes a tub body 41 located in the drawer body 31 for storing water and a tub cover 43 configured to define the upper surface of the tub body 41.

The tub body 41 may be configured as a cylindrical shape that is open at the upper surface thereof. A heater 411 for heating water may be provided in the tub body 41.

The diameter of the tub body 41 is greater than the height of the tub body 41. In other words, the vertical length of the tub body 41 is greater than the horizontal length of the tub body 41.

The tub cover 43 may include an introduction port 431, through which the inside and outside of the tub body 41 communicate with each other, and a supply port 433, through which water is supplied into the tub body 41.

The tub cover 43 covers the open upper surface of the tub body 41 such that the inside and outside of the tub communicate with each other through the introduction port 431.

The introduction port 431 may be provided under the first through hole 351 provided in the drawer cover, and the supply port 433 may be provided under the second through hole 353 provided in the drawer cover.

Through the introduction port 431, laundry is supplied into the tub body 41 or withdrawing the laundry from the tub body 41. The introduction port 431 is opened and closed by a door 45.

Figure 3:
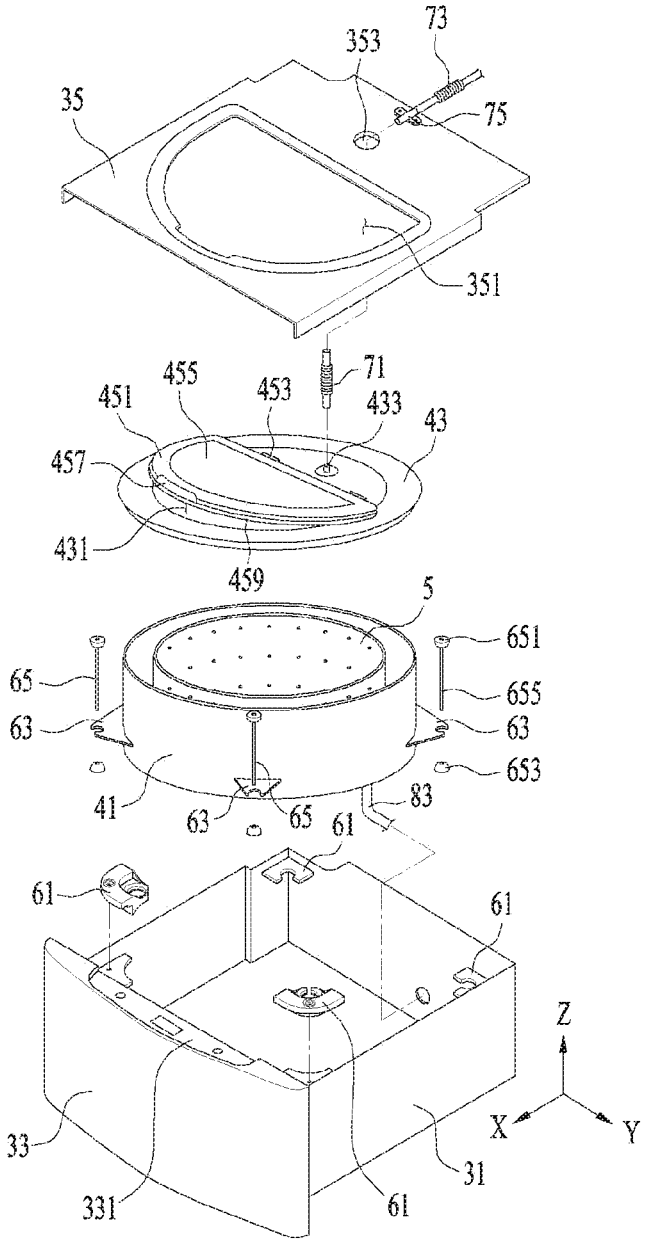
FIG. 3 is a diagram illustrating an example drawer, an example tub, and an example drum.
Figure 4:
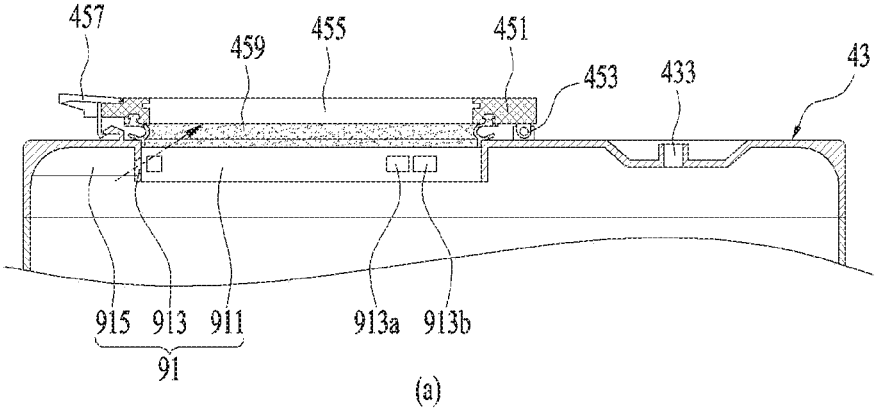
FIG. 4 is a diagram illustrating an example washing unit of a laundry treatment apparatus.
Figure 4:
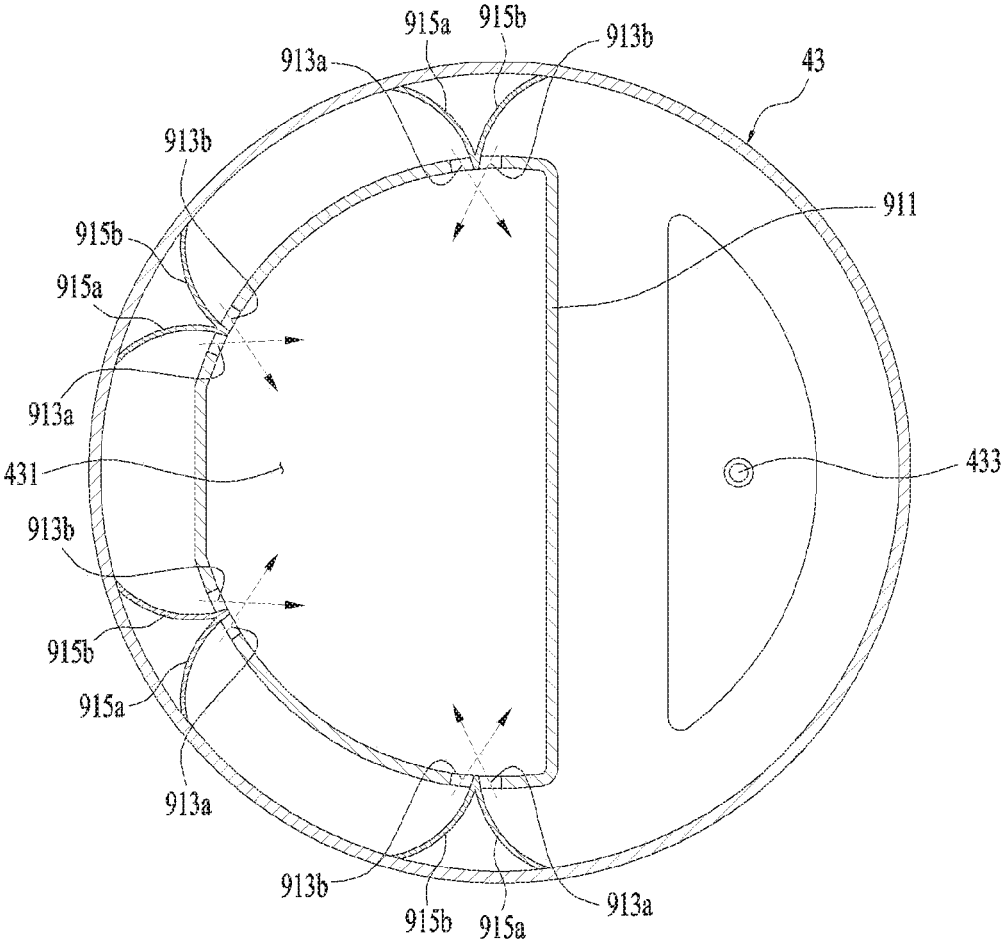

FIG. 3 illustrates an example drawer, an example tub, and an example drum. FIG. 4 illustrates an example washing unit of a laundry treatment apparatus.

As shown in FIGS. 3 and 4, the door 45 may include a frame 451 rotatably coupled to the tub cover 43 via a hinge 453, a window 455 provided in the frame, and a door handle 457 for separably coupling the frame 451 to the tub cover 43.

The window 455 may be made of a transparent material such that the user can check the interior of the tub body 41 when the drawer 3 is withdrawn from the cabinet 2.

One end of the door 45 is connected to the upper surface of the tub cover 43 such that the door 45 is turned to open and close the introduction port 431.

A hook 450, which is provided at the other end of the door 45, is fastened to a hook hanger 430, which is provided at the tub cover 43, so as to fix the door 45. When the door 45 is closed, the tub 4 is sealed.

The laundry treatment apparatus is different from a general top loading type washer in that, in the general top loading type washer, the upper surface of the tub is open and the interior of the tub communicates with the interior of the cabinet, whereas, in the laundry treatment apparatus, however, the upper surface of the tub is closed and the introduction port 431 formed in the upper surface of the tub 4 is sealed by the door 45 rotatably provided at the upper surface of the tub cover 43, whereby the interior of the tub 4 does not communicate with the interior of the cabinet. That is, the interior of the tub 4 is sealed.

The reason that the upper surface of the tub is closed in the laundry treatment apparatus is that a large amount of bubbles may be generated in the tub 4 due to the rotation of the drum and the generated bubbles may flow outward through the upper surface of the tub, since the height of the tub 4 is smaller than the diameter of the tub 4. In order to solve this problem, the upper surface of the tub is closed.

In some implementations, in order to prevent the water in the tub body 41 from being discharged out of the tub body 41 through the introduction port 431, any one selected from between the frame 451 and the tub cover 43 may be further provided with a sealing part 459 for sealing the gap between the frame 451 and the introduction port 431 when the door 45 closes the introduction port 431.

The tub 4 having the above structure is coupled to the drawer body 31 via a tub support unit 6. The tub support unit 6 may include a first support part 61 provided at the drawer body 31, a second support part 63 provided at the tub body 41, and a connection part 65 for connecting the first support part and the second support part to each other.

The connection part 65 may include a first connection part 651 located in the first support part 61, a second connection part 653 for supporting the second support part 63, and a bar 655 for connecting the first connection part and the second connection part to each other.

The first connection part 651 may be formed in a shape in which the first connection part 651 is movable in the first support part 61 while being 651 located in the first support part 61, and the second connection part 653 may be formed in a shape in which the second connection part 653 is movable in the second support part 63 while supporting the second support part 63.

FIG. 2 shows the case in which each of the first and second connection parts 651 and 653 is formed in a spherical shape by way of example, and FIG. 3 shows the case in which the surface of each of the connection parts 651 and 653 that contacts a corresponding one of the support parts 61 and 63 is formed in a hemispherical shape by way of example.

In some implementations, as shown in FIG. 2, the bar 655 may be configured to be perpendicular to the bottom surface of the cabinet 2 (i.e. configured to be parallel to the height direction Z of the cabinet and to be perpendicular to the bottom surface of the drawer).

In this example, at least three tub support units 6 are provided to couple the tub body 41 to the drawer body 31, and the bars 655 are perpendicular to the bottom surface of the cabinet. Consequently, it is possible to increase the distance between the tub cover 43 and the drawer cover 35, compared to the case in which the bars 655 are inclined from the Z axis by a predetermined angle.

Consequently, the tub support units 6 included in this example may minimize the possibility of the tub cover 43 colliding with the drawer cover 35 even when the tub body 41 vibrates in the drawer body 31.

In some implementations, in the case in which the bars 655 are perpendicular to the bottom surface of the drawer, at least one of the first and second support parts 61 and 63 may be separably provided at the drawer body 31.

In the case in which at least three tub support units 6 are provided and the first support part 61 and the second support part 63 are fixedly provided at the drawer body 31, a worker who wishes to fix the tub 41 to the drawer body 31 must insert the tub body 41 into the drawer body 31 such that the second support part 63 does not interfere with the first support part 61 and then rotate the tub body 41 such that the second support part 63 is located on the vertical line passing through the first support part 61 in order to couple the first connection part 651 to the first support part 61.

In the case in which the bars 655 of the tub support units 6 are perpendicular to the bottom surface of the drawer, however, the gap S between the outer circumferential surface of the tub body 41 and the inner circumferential surface of the drawer body 41 may be minimized, thereby minimizing the volume of the laundry treatment apparatus 100, but the efficiency in assembly of the first connection part 651 and the first support part 61 performed through the above procedure may be deteriorated. This problem may be solved in the case in which the first support part 61 is separably provided at the drawer body 41.

The drum 5, provided in the tub 4, may include a cylindrical drum body 51 having an open surface 53 provided in the upper part thereof. The open surface 53 is located under the introduction port 431. Consequently, laundry supplied through the introduction port 431 is introduced into the drum body 51 through the open surface 53.

In some implementations, the drum body 51 may be provided in the bottom surface 57 and the circumferential surface 55 thereof with a plurality of drum through holes 59, through which the inside of the drum body 51 and the tub body 41 communicate with each other.

The drum body 51 is rotated in the tub body 41 by a driving unit M (e.g. a motor). The driving unit M may include a stator M1 fixed to the bottom surface of the tub body while being located outside the tub body 41, a rotor M2 configured to be rotated by a rotating field provided by the stator, and a shaft M3 extending through the bottom surface of the tub body 41 for connecting the bottom surface 57 of the drum and the rotor M2 to each other. In this case, the shaft M3 may be perpendicular to the bottom surface of the tub body 41.

In the laundry treatment apparatus 100 having the above structure, water is supplied to the tub 4 through a water supply unit 7, and the water stored in the tub 4 is discharged out of the cabinet 2 through a drainage unit 8.

As shown in FIG. 2, the water supply unit 7 may include a first water supply pipe 71 connected to the supply port 433, which is provided at the tub cover, a second water supply pipe 73 connected to a water supply source located outside the cabinet, and a connection pipe 75 fixed to the tub cover 43 for connecting the first water supply pipe and the second water supply pipe to each other.

The first water supply pipe 71 may connect the supply port 433 and the connection pipe 75 to each other through the second through hole 353, which is provided in the drawer cover 35, and may be configured as a bellows pipe so as to prevent the first water supply pipe 71 from being separated from the connection pipe 75 when the tub 4 vibrates (see FIG. 3).

In addition, the second water supply pipe 73 may also be configured as a bellows pipe so as to prevent the second water supply pipe 72 from being separated from the connection pipe 75 when the drawer is withdrawn from the cabinet 2. The second water supply pipe 73 is opened and closed by a water supply valve 77 under the control of a controller 101.

Unlike what is shown in FIG. 2, however, the water supply unit 7 may include a single water supply pipe for connecting a water supply source located outside the cabinet and the supply port 433, which is provided at the tub cover. In this case, the water supply pipe may be configured as a bellows pipe.

The drainage unit 8 may include a drainage pump 81 fixed to the drawer body 31, a first drainage pipe 83 for guiding the water from the tub body 41 to the drainage pump 81, and a second drainage pipe 85 for guiding the water discharged from the drainage pump 81 out of the cabinet 2. In this case, the second drainage pipe 85 may be configured as a bellows pipe. The controller 101 controls the operation of the drainage pump 81 such that water from the tub 4 is drained to the outside via the first drainage pipe 83, the drainage pump 81, and the second drainage pipe 85.

In the laundry treatment apparatus 100 having the above structure, laundry is introduced into the drum 5, water and detergent are supplied into the tub 4, and the drum 5 is rotated by the driving unit to wash the laundry.

During the rotation of the drum 5, a stream of water is generated in the tub 4. Consequently, bubbles generated when the detergent is dissolved during washing of the laundry or dirt separated from the laundry may remain on the door 45 or the drum 5 after the completion of washing.

If bubbles or dirt remain on the inner surface of the door 45 or the circumferential surface of the drum after the completion of washing, the user may misjudge that washing of the laundry has not been completed or may suspect that the laundry treatment apparatus 100 is out of order.

In order to solve the above problem, the laundry treatment apparatus 100 may further include at least one selected from between a washing unit 91 for removing foreign matter (e.g. bubbles or dirt) from the door 45 and a spray unit 93 for preventing the generation of bubbles and washing the drum.

The washing unit 91 shown in FIG. 4 can wash the door 45 using centrifugal force generated during the rotation of the drum 5.

The shaft M3 of the drum 5, which forms the center of rotation, is perpendicular to the bottom surface of the tub body. When the drum 5 is rotated, therefore, the water in the tub 4 moves upward along the circumferential surface of the tub body 41 by centrifugal force and then moves toward the introduction port 431 along the tub cover 43. In this example, the washing unit 91 discharges the water that has moved to the tub cover 43 by centrifugal force toward the door 45 to wash the door 45.

The washing unit 91 of FIG. 4 may include a blocking wall 911 protruding from the tub cover 43 toward the upper surface of the drum 5, a guide 915 extending from the edge of the tub cover 43 toward the blocking wall 911, and a discharge part 913 formed through the blocking wall for discharging the water moving along the guide 915 toward the door 45.

The blocking wall 911 may be configured to surround the entirety of the introduction port 431 or to intermittently surround the introduction port 431. The expression "the blocking wall intermittently surrounds the introduction port" means that a plurality of blocking walls is arranged along the edge of the introduction port at intervals.

FIG. 4(*b*) shows the case in which the blocking wall 911 is configured to surround the entirety of the introduction port 431. In this case, the blocking wall 911 may protrude from the edge of the introduction port 431 toward the drum 5.

In some implementations, in the case in which the door 45 is rotatably coupled to the upper surface of the tub cover 43, with the result that the inner surface of the door 45 (i.e. the surface of the door that contacts water) is at a higher position than the discharge part 913, the discharge part 913 may be inclined at a predetermined angle so as to discharge water toward the door 45.

Furthermore, in the case in which the door 45 is provided with a transparent window 455, the user may check whether foreign matter remains through the window 455. Consequently, the discharge part 913 may be inclined at a predetermined angle so as to discharge water toward the window 455.

The guide 915 may include a first guide 915*a* for guiding water moving toward the edge of the tub cover 43 to the discharge part 913 when the drum 5 is rotated in the clockwise direction and a second guide 915*b* for guiding water moving toward the edge of the tub cover 43 to the discharge part 913 when the drum 5 is rotated in the counterclockwise direction.

In the case in which the discharge part 913 includes a single hole formed through the blocking wall 911, the guides 915*a* and 915*b* guide water to the discharge part 913. In the case in which the discharge part 913 includes a first discharge part 913*a* and a second discharge part 913*b* formed through the blocking wall 911, however, the first guide 915*a* may be configured to guide water to the first discharge part 913*a*, and the second guide 915*b* may be configured to guide water to the second discharge part 913*b*.

The direction in which the water moves along the first guide 915*a* is opposite the direction in which the water moves along the second guide 915*b*. Consequently, the washing unit 91 may wash the door 45 irrespective of the rotational direction of the drum as long as the number of rotations of the drum 5 is equal to or greater than a predetermined reference number of rotations (e.g. the number of rotations at which the water in the tub body moves upward to the tub cover due to centrifugal force).

In addition, the discharge parts 913*a* and 913*b* may be inclined at a predetermined angle such that the trajectory of the water discharged from the first discharge part 913*a* and the trajectory of the water discharged from the second discharge part 913*b* intersect. In this case, the washing range of the washing unit 91 may be increased.

A plurality of washing units 91 may be arranged along the edge of the introduction port 431. The washing units 91 may be arranged so as to surround the introduction port 431. Furthermore, at least two of the washing units 91 may be opposite each other in order to increase the washing force of the washing units 91.

Figure 5:
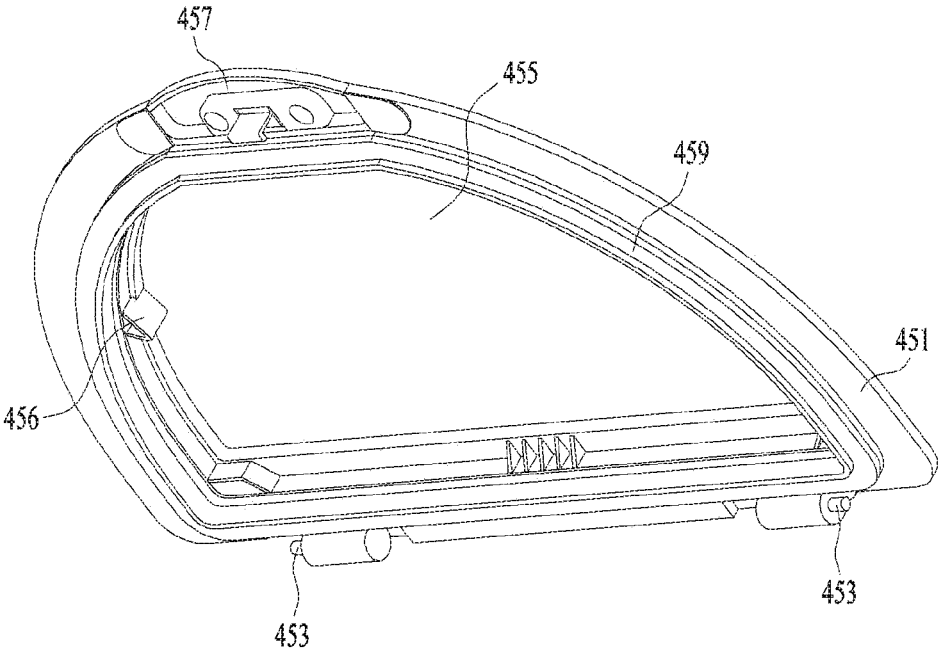
FIG. 5 is a diagram illustrating an example washing guide of a laundry treatment apparatus.
Figure 5:
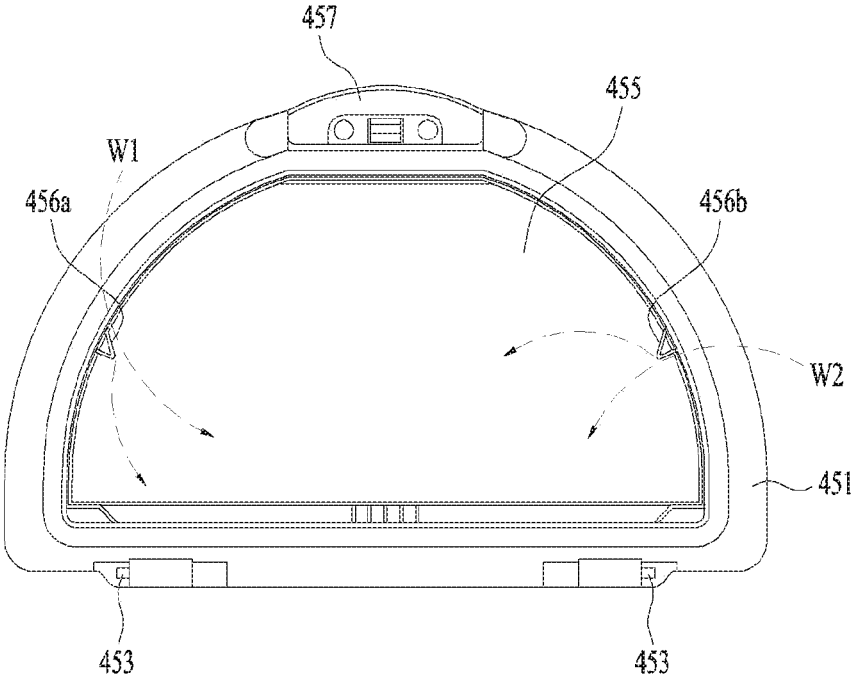

FIG. 5 illustrates an example washing guide of a laundry treatment apparatus. In some implementations, foreign matter remaining on the door 45 may be removed using a washing guide 456 shown in FIG. 5. The washing guide 456 may be provided at the edge of the window 455. During the rotation of the drum, the water in the tub moves from the bottom surface of the tub to the edge of the frame 451 by centrifugal force and, in addition, moves along the edge of the frame 451. In the case in which the washing guide 456 is provided at the edge of the window 455, some of the water moving along the edge of the frame 451 may be guided toward the center of the window 455 (W1 and W2). In this example, therefore, it is possible to prevent foreign matter from remaining on the window through the washing guide 456.

In order to maximize the washing area, however, the washing guide 456 may include a first washing guide 456*a* and a second washing guide 456*b* provided symmetrically thereto on the basis of a line of symmetry Q of the door 45 (see FIG. 5(*b*)).

In this example, either the washing unit 91 or the washing guide 456 may be included, or both the washing unit 91 and the washing guide 456 may be included.

Figure 6:
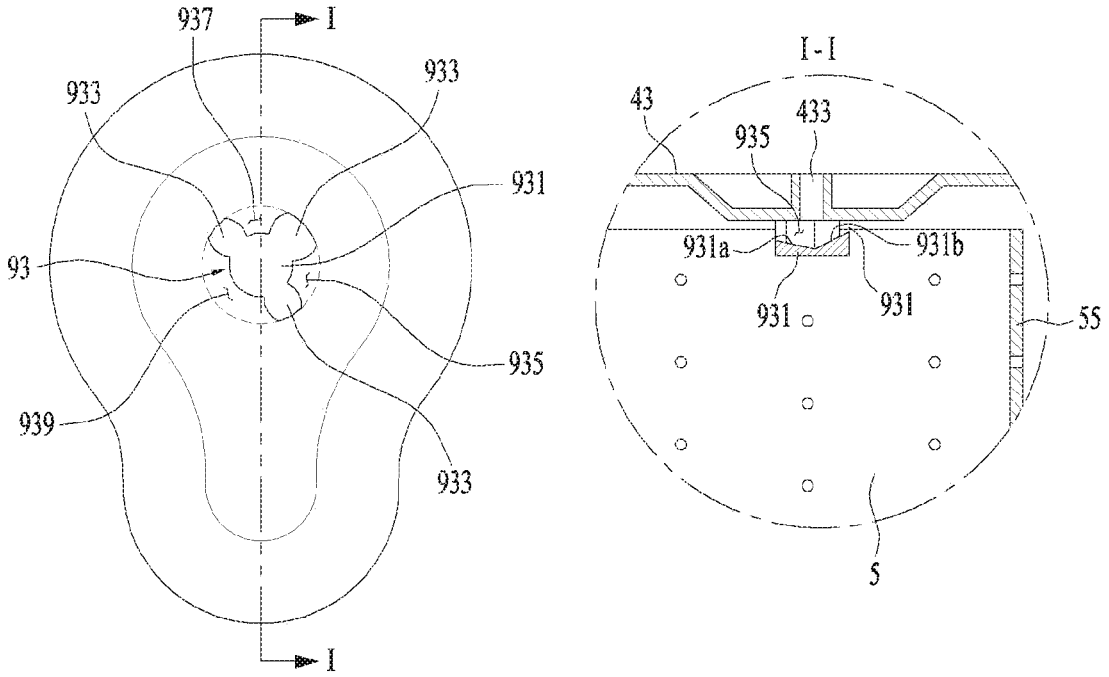
FIG. 6 is a diagram illustrating an example spray unit of a laundry treatment apparatus.

FIG. 6 illustrates an example spray unit of a laundry treatment apparatus.

FIG. 6 shows an example of a spray unit 93 for spraying water introduced through the supply port 433 to the drum 5 to wash the inner circumferential surface of the drum or remove bubbles generated in the drum.

In this example, the spray unit 93 sprays water in at least two different directions. The spray unit 93 of FIG. 6 may include an extension part 933 protruding from the tub cover 43 so as to surround the supply port 433, a body 931 fixed to the extension part 933 so as to be spaced apart from the supply port 433 by a predetermined distance, and at least two spray ports formed through the extension part 933 for discharging water from the extension part 933.

FIG. 6 shows the case in which the spray unit 93 includes a first spray port 935, a second spray port 937, and a third spray port 939 by way of example. The spray ports 935, 937, and 939 may be spaced apart from one another by different distances.

In some implementations, at least one of the spray ports 935, 937, and 939 may be configured to spray water toward the circumferential surface 55 of the drum in order to wash the circumferential surface of the drum, and at least one of the spray ports may be configured to spray water toward the bottom surface of the drum in order to remove bubbles generated in the drum.

In order to increase the pressure of the water discharged through the spray ports 935, 937, and 939, the body 931 may be provided with an inclined surface that is inclined upward toward the spray ports 935, 937, and 939.

The inclined surface may include a first inclined surface 931*a* that is inclined upward from the surface of the body 931 toward the first spray port 935, a second inclined surface 931*b* that is inclined upward from the surface of the body toward the second spray port 937, and a third inclined surface that is inclined upward from the surface of the body 931 toward the third spray port 939.

The sectional area of a water channel is gradually decreased from the center of the body 931 toward the spray ports 935, 937, and 939 due to the inclined surfaces 931*a* and 931*b*. In this example, therefore, the pressure of water discharged through the spray ports 935, 937, and 939 is increased, whereby the spray unit 93 may spray water a long distance.

In some implementations, the spray unit 93 having the above structure may be spaced apart from the center of rotation of the drum 5 by a predetermined distance. If the spray unit 93 is located at the same position as the center of rotation of the drum, the spray unit 93 can spray water to the edge of the drum, but it is difficult for the spray unit 93 to spray water to the center of rotation of the drum, which is located under the spray unit 93.

The body 931 may be provided with a through hole to supply water to the center of rotation of the drum. In this case, however, the pressure of the water discharged through the spray ports 935, 937, and 939 may be reduced.

In the case in which the spray unit 93 is provided so as not to be located on a straight line passing through the center of rotation of the drum, it is possible to supply water to the entire area of the drum without reducing the pressure of the water sprayed from the spray unit 93.

If a large amount of bubbles are generated in the tub by the rotation of the drum, the pressure in the tub is increased, whereby the door 45 may be opened, or the bubbles may leak through the gap between the door 45 and the tub cover 43. The leaking bubbles may cause a short circuit in a device using electricity, such as a motor. In addition, if bubbles remain on the inner surface of the door 45 after washing has been completed, the user may doubt the washing performance of the laundry treatment apparatus. As a result, rewashing may be performed, or the user may manually wash the door 45.

Hereinafter, a method of controlling the laundry treatment apparatus that is capable of sensing bubbles generated in the tub 4 and of preventing the generation of bubbles will be described.

Figure 7:
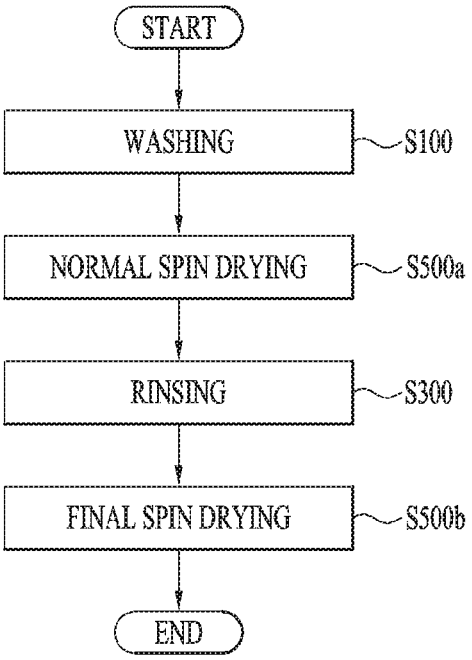
FIG. 7 is a flowchart illustrating an example method for controlling a laundry treatment apparatus.

FIG. 7 is a flowchart illustrating an example method for controlling a laundry treatment apparatus.

The method of controlling the laundry treatment apparatus may include a washing cycle (S100) for washing laundry using detergent, a rinsing cycle (S300) for rinsing the laundry to remove the detergent from the laundry, and a spin-drying cycle (S500) for squeezing water from the laundry.

The spin-drying cycle (S500) may include a final spin-drying cycle (S500*b*) for removing water from the laundry after the rinsing cycle (S300) and a normal spin-drying cycle (S500*a*) for removing water from the laundry before the rinsing cycle (S300) or after the washing cycle (S100).

After the washing cycle (S100), the normal spin-drying cycle (S500*a*) and the rinsing cycle (S300) may be performed a plurality of times depending on a selected washing course or the weight of laundry.

The normal spin-drying cycle (S500*a*) may be referred to as intermediate spin drying, which is different from final spin drying. After washing is performed, wash water is drained, and intermediate spin drying is performed, the supply of water and rinsing may be performed. In addition, after rinsing is performed and wash water is drained, intermediate spin drying may be performed. After intermediate spin drying is performed, the supply of water and rinsing may be performed.

In the case in which rinsing is performed three times in a normal washing course, therefore, intermediate spin drying may be performed after washing, intermediate spin drying may be performed after first rinsing, intermediate spin drying may be performed after second rinsing, and final spin drying may be performed after third rinsing.

The laundry treatment apparatus is integrally formed with a relatively small-sized general washer or dryer or is used together with the washer or dryer. Since the volume of the tub is relatively small, therefore, the possibility of bubble generation is relatively high.

When an appropriate amount of detergent is supplied, the possibility of bubble generation may be eliminated. However, some users tend to supply an excessive amount of detergent. In this case, bubbles remain on laundry or the door after a washing course is completed, which considerably reduces user satisfaction.

In the laundry treatment apparatus, therefore, the removal or reduction of bubbles is critical.

Hereinafter, a description will be made of a method of controlling the laundry treatment apparatus to sense bubbles generated in the tub 4 during the washing cycle (S100) or the spin-drying cycle (S500) and to remove or reduce bubbles on the lower surface of the tub cover 43 or the lower surface of the door 45.

Figure 8:
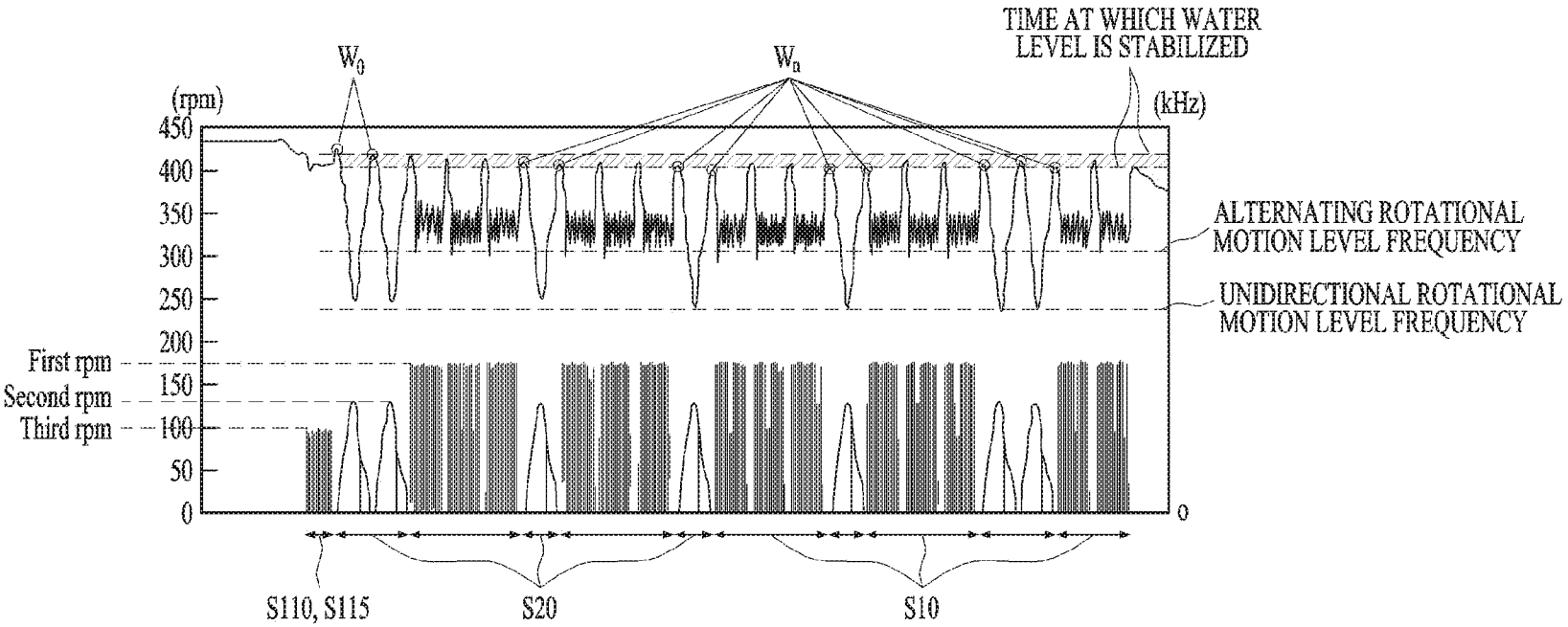
FIG. 8 is a graph illustrating an example rotational speed of a drum and an example level of water in a tub in a washing cycle of a laundry treatment apparatus.

FIG. 8 illustrates an example rotational speed of a drum and an example level of water in a tub in a washing cycle of a laundry treatment apparatus.

The washing cycle (S100) may include an alternating rotational motion (S10) in which the drum is rotated in alternating directions to provide mechanical force and frictional force for washing laundry in the drum 5 and a unidirectional rotational motion (S20) in which the drum is rotated in one direction such that the water in the tub 4 moves upward and downward along the inner circumferential surface of the tub 4.

In the alternating rotational motion (S10), the drum 5 may be rotated at a first rpm in alternating directions. The water in the tub is shaken by the drum rotated at the first rpm, the level of water in the tub is repeatedly increased and decreased within a predetermined period, and the maximum level of water in the tub is measured as an alternating rotational motion level frequency.

In the unidirectional rotational motion (S20), the drum 5 may be rotated in one direction such that the rotational speed of the drum becomes a second rpm. The rotational speed of the drum is increased, and is then decreased when the rotational speed of the drum reaches the second rpm. The water in the tub 4 moves upward to the tub cover 43 along the inner circumferential surface of the tub 4 due to the rotational force of the drum, but does not overlap water moving upward along the inner circumferential surface of the tub 4 on the opposite side thereof at the lower side of the tub cover 43. In this case, the maximum level of water in the tub is the highest in the washing cycle, and is measured as a unidirectional rotational motion level frequency.

In the unidirectional rotational motion (S20), the water in the tub contacts the lower surface of the tub cover 43, but falls into the drum through the open surface 55 of the drum due to the weight thereof. In order words, the water in the tub moves upward along the inner circumferential surface of the tub, but does not reach the center of the tub cover. The water in the tub falls into the drum due to the weight thereof to collide with laundry, thereby improving the washing effect. The first rpm in the alternating rotational motion (S10) is higher than the second rpm in the unidirectional rotational motion (S20), but the maximum level of water in the tub in the alternating rotational motion (S10) is lower than that of the water in the tub in the unidirectional rotational motion (S20). The reason for this is that the rotational speed of the drum in the unidirectional rotational motion (S20) is low but is increased only in one direction for a short time to reach the second rpm, whereby a great stream of water is generated in the tub, with the result that the water in the tub reaches the tub cover. In contrast, in the alternating rotational motion (S10), the drum is rotated in alternating directions, i.e. in the clockwise direction and the counterclockwise direction, whereby a great stream of water is not generated in the tub, with the result that the water in the tub does not reach the tub cover.

The alternating rotational motion (S10) and the unidirectional rotational motion (S20) may be alternately performed. The alternating rotational motion (S10) may be repeatedly performed a plurality of times after the unidirectional rotational motion (S20) is performed a plurality of times. The unidirectional rotational motion (S20) is performed after the alternating rotational motion (S10) is performed one time and before the alternating rotational motion (S10) is performed another time in order to improve washing performance and reduce a load of the motor M, which rotates the drum, i.e. to cool the motor.

Forward and reverse rotation time in the alternating rotational motion (S10) may be shorter than unidirectional rotation time in the unidirectional rotational motion (S20). Consequently, the magnitude of a stream of water or a range in which the stream of water is movable in the unidirectional rotational motion is larger than that in the alternating rotational motion.

In conclusion, the possibility of bubble generation may be high in a drum motion in which the magnitude of a stream of water is large, and the possibility of bubble generation may be low in a drum motion in which the magnitude of a stream of water is small.

In some implementations, the magnitude of the stream of water in the unidirectional rotational motion (S20) may be smaller than that in the alternating rotational motion (S10), which may be realized by further reducing the second rpm. In addition, the rpm in the alternating rotational motion (S10) may include two or more different rpms. The magnitude of the stream of water may be small at the low rpm, and the magnitude of the stream of water may be large at the high rpm.

In general, therefore, the higher the rpm, the larger the magnitude of the stream of water, which, however, is not always true. The reason for this is that the longer rotation is continued or the more abruptly rotation is stopped, the more the magnitude of the stream of water may differ, even at the same rpm.

In this example, the washing cycle may be performed using at least one motion, which may be the alternating rotational motion, the unidirectional rotational motion, or a combination thereof. In addition, motions having different rpms may be performed in the alternating rotational motion or in the unidirectional rotational motion. In any case, the possibility of bubble generation may be high in a motion in which the magnitude of the stream of water is large. As long as the load of the motor is not large and noise is acceptable, however, a motion in which the magnitude of the stream of water is large may be performed in order to improve the washing effect and to reduce the washing time.

Figure 9:
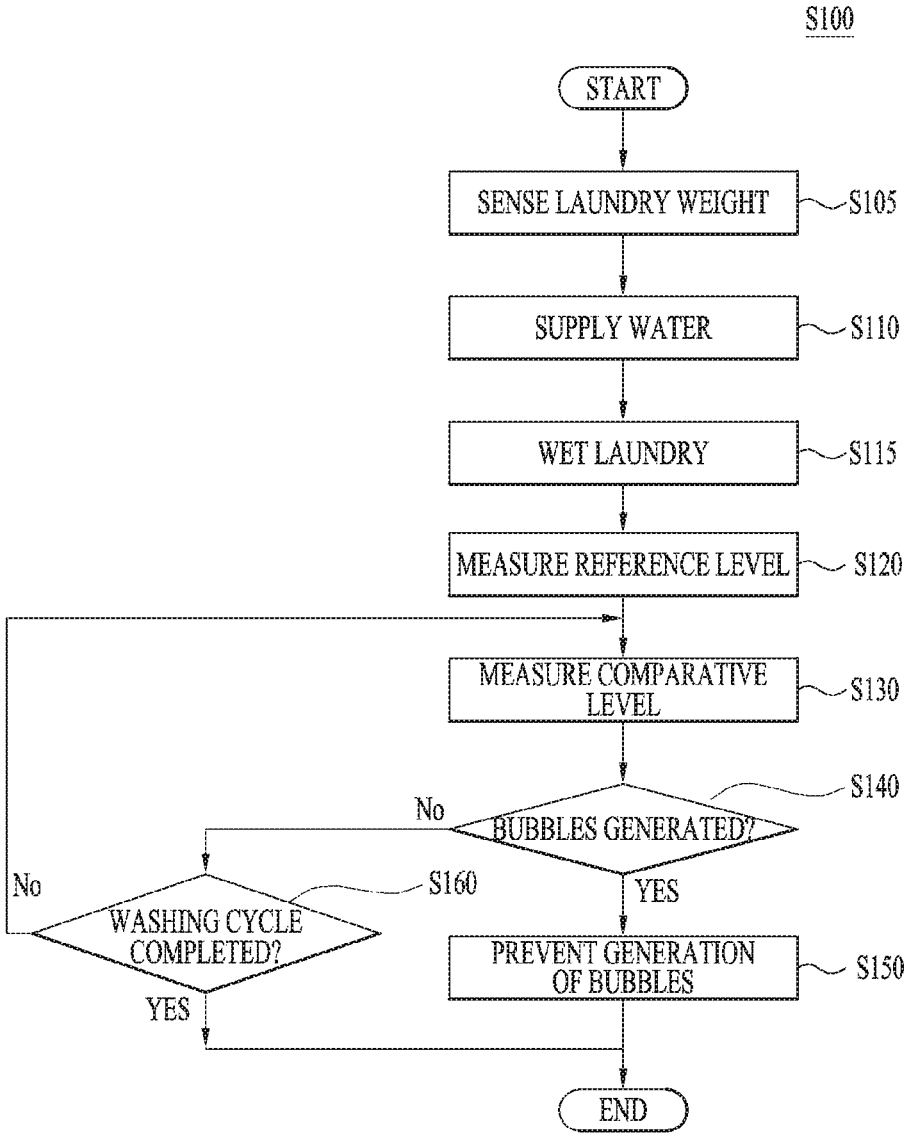
FIG. 9 is a flowchart illustrating an example method for controlling the laundry treatment apparatus.

FIG. 9 illustrates an example method for controlling the laundry treatment apparatus.

For example, preventing the generation of bubbles may be a concept including removing generated bubbles or reducing the amount of generated bubbles. In addition, preventing the generation of bubbles may further include preventing further generation of bubbles.

The method of controlling the laundry treatment apparatus may include a step (S110) of supplying water to the tub 4, a step (S120) of measuring a reference level Ho at a time at which the level of water stored in the tub 4 is stabilized, a step (S130) of measuring a comparative level Hn at a time at which the level of water stored in the tub 4 is stabilized after the drum 5 is rotated in alternating directions, and steps (S140 and S150) of determining whether bubbles have been generated in the tub 4 and preventing the generation of bubbles.

Consequently, bubbles generated in the tub 4 during the washing cycle (S100) are sensed and removed to prevent washing from not being performed due to the bubbles, to reduce the load on the motor M, which rotates the drum 5, and to prevent the bubbles from leaking to the outside through the introduction port 431 of the tub 4.

The water supplied to the tub 4 at step S110 contains detergent. That is, the water is mixed with detergent that is initially supplied to dry laundry for washing.

A step (S105) of sensing the weight of laundry stored in the drum 5 (hereinafter, referred to as "dry laundry weight") may be performed before the step (S110) of supplying water to the tub 4. The level of water to be supplied to the tub at step S110 is set depending on the dry laundry weight measured at step S105.

In some implementations, a step (S115) of wetting the laundry may be performed after the step (S110) of supplying water to the tub 4. At step S115, the drum is rotated at a third rpm to wet the laundry. The third rpm at the laundry wetting step is lower than a first rpm and a second rpm. Alternatively, the laundry wetting step (S115) may be performed simultaneously with the step (S110) of supplying water to the tub 4.

Hereinafter, the step (S120) of measuring the reference level Ho at the time at which the level of water stored in the tub 4 is stabilized will be described.

Step S120 is performed after the step (S110) of supplying water to the tub 4 is completed.

The time at which the level of water stored in the tub 4 is stabilized is a time at which the water in the tub 4 is not shaken in the washing cycle (S100). For example, the time at which the level of water stored in the tub 4 is stabilized may be a time at which water is supplied to the tub and waiting may be performed for a predetermined time or a time at which the motion of the drum is changed in the washing cycle (S100).

In a first example, the time at which the level of water stored in the tub 4 is stabilized may be after the laundry wetting step is performed. In this case, the first rpm at the laundry wetting step (S115) may be a low rpm at which the water in the tub 4 is not shaken. Consequently, the level of water in the tub 4 immediately after the laundry wetting step is completed may be measured as a reference level Ho.

In a second example, a step (S117) of performing waiting for a predetermined time without rotating the drum such that the level of water supplied to the tub 4 is stabilized may be included. Step S117 may be performed before the step (S120) of measuring the reference level Ho or after the laundry wetting step (S115). That is, a resting period, in which the drum is not rotated, may be provided after water supply or laundry wetting such that the water in the tub 4 becomes calm, and the level of water in the tub 4 may be measured as a reference level Ho at the end of the resting period, which is considered to be the time at which the level of water stored in the tub 4 is stabilized.

In a third example, the time at which the level of water stored in the tub 4 is stabilized may be a time immediately before the drum is rotated in order to perform the unidirectional rotational motion (S20). Since the motor M must rotate the drum at the second rpm, which is set as the highest speed, for a predetermined time in the unidirectional rotational motion (S20), it is necessary to readjust the angles of the stator M1 and the rotor M2. Consequently, the drum 5 is stopped for a predetermined time or is slowly rotated such that the water in the tub remains calm. At this time, the reference level Ho of the tub may be measured.

Hereinafter, a method of measuring the level of water stored in the tub 4 will be described.

The laundry treatment apparatus may include a water level sensor 102 for transmitting electromagnetic waves (including ultrasonic waves) to bubbles or water and receiving electromagnetic waves reflected by the bubbles or the water.

In one example, in the case in which the level of water stored in the tub 4 is directly measured, the water level sensor is provided at the upper side of the tub 4 to measure the level of water in the tub 4. In the case in which bubbles are generated in the tub, the level of water measured by the water level sensor is the level of water including the height of bubbles provided above the water. The level frequency measured by the water level sensor is in inverse proportion to the level of water in the tub. That is, in the case in which the level frequency is high, the level of water in the tub may be low, and in the case in which the level frequency is low, the level of water in the tub may be high.

In another example, in the case in which the level of water stored in the tub 4 is indirectly measured, the water level sensor 102 may measure the level of water in a water level pipe 102*a* provided so as to be parallel to the tub 4. The water level pipe 102*a* is connected to the lower side of the tub 4. At atmospheric pressure, the level of water in the tub 4 is equal to that in the water level pipe 102*a*. In the case in which bubbles are generated in the sealed tub, the pressure in the tub is increased, and the level of water stored in the water level pipe 102*a* is increased. That is, when the level of water in the water level pipe 102*a* is increased, it may be determined that the level of water in the tub including the height of the bubbles provided above the water is increased. Even in this case, when the level frequency of water in the water level pipe 102*a* measured by the water level sensor is low, it may be determined that the level of water in the water level pipe is high and that the level of water in the tub including the height of the bubbles has been increased.

At step S120, the level of water measured before the alternating rotational motion (S10) of the washing cycle (S100) is performed is set as a reference level Ho. In the case in which the time at which the level of water stored in the tub 4 is stabilized is present several times before the alternating rotational motion (S10), the average of the levels of water measured at the respective times is set as the reference level Ho. The controller 101 stores the value of the reference level measured by the water level sensor 102 in a storage unit 105. In the case in which the value of the reference level is measured several times, the average of the values of the reference level stored in the storage unit is stored in the storage unit 105 as a new reference level.

In this example control method, the unidirectional rotational motion (S20) may be performed twice before the alternating rotational motion (S10), and the average of the levels of water in the tub measured twice may be set as the reference level Ho.

Hereinafter, the step (S130) of measuring the comparative level Hn at the time at which the level of water stored in the tub 4 is stabilized after the drum 5 is rotated in alternating directions will be described.

Here, the time at which the level of water stored in the tub 4 is stabilized may be a time at which waiting is performed for a predetermined time without rotating the drum or a time immediately before the drum is rotated in order to perform the unidirectional rotational motion (S20), which has been previously described, and therefore a detailed description thereof will be omitted.

Furthermore, the time at which the level of water stored in the tub 4 is stabilized may be defined as a time at which switching is performed between the unidirectional rotational motion (S20) and the alternating rotational motion (S10). For example, the time at which the level of water stored in the tub 4 is stabilized may be a time after the unidirectional rotational motion is performed and before the alternating rotational motion is performed or a time after the alternating rotational motion is performed and before the unidirectional rotational motion is performed. The reason for this is that it is necessary to realign the rotor so as to check the position of the rotor relative to the stator at a time at which switching is performed between the motions of the drum. At this time, the water in the tub remains calm.

At step S130, the level of water measured at a time at which the level of water is stabilized after the alternating rotational motion (S10) of the washing cycle (S100) is performed is set as a comparative level Hn.

In some implementations, the steps (S140 and S150) of determining whether bubbles have been generated in the tub 4 and of preventing the generation of bubbles may include a step (S140) of determining whether bubbles have been generated in the tub 4 and a step (S150) of preventing the generation of bubbles. Here, the step of preventing the generation of bubbles may be a step of reducing the amount of bubbles.

At the step (S140) of determining whether bubbles have been generated in the tub 4, the reference level Ho is compared with the comparative level Hn to determine whether bubbles have been generated in the tub. Specifically, the difference between the reference level Ho and the comparative level Hn is compared with a predetermined value stored in the storage unit 105. As previously described, in the reference level Ho and the comparative level Hn, the level of water is the sum of the height of the water stored in the tub and the height of bubbles provided above the water.

For example, in the case in which the difference between the reference level Ho and the comparative level Hn is greater than the predetermined value, it is determined that bubbles have been generated in the tub. In the case in which the difference between the reference level Ho and the comparative level Hn is less than the predetermined value, it is determined that bubbles have not been generated in the tub or that bubbles are generated but the bubbles do not reach the upper surface of the tub. Only in the case in which the difference between the reference level Ho and the comparative level Hn is a positive number, it is determined that bubbles have been generated.

This may be understood based on the concept of a level frequency. In the case in which bubbles have been generated, a comparative level frequency Wn is detected to be a smaller value than a reference level frequency Wo. In the case in which the difference between the reference level frequency Wo and the comparative level frequency Wn is greater than a predetermined frequency, it is determined that bubbles have been generated. In this example, the predetermined frequency may be about 0.3 kHz.

Upon determining at step S140 that bubbles have not been generated in the tub, it is determined whether the washing cycle has been completed. Upon determining that the washing cycle has not been completed, the comparative level Hn is measured, and the step (S140) of determining whether bubbles have been generated and the step (S150) of preventing the generation of bubbles are performed again. The case in which the washing cycle has not been completed is the case in which the time at which the level of water is stabilized occurs again within the remaining washing cycle, i.e. the case in which pluralities of unidirectional rotational motions and alternating rotational motions remain in the washing cycle.

Consequently, the step (S140) of determining whether bubbles have been generated may be continuously performed until the washing cycle is completed. That is, the washing cycle is performed until bubbles are sensed, and, finally, the washing cycle is completed in the case in which bubbles are not sensed.

Therefore, FIG. 8 shows an example in which the washing cycle is performed and completed according to a predetermined logic. That is, the sequence or combination of drum motions may be predetermined, and the time at which bubbles are sensed may be predetermined. When bubbles are not sensed, the washing cycle is performed and completed according to the predetermined logic. When bubbles are not sensed during the washing cycle, therefore, washing may be performed according to a predetermined optimum logic.

Upon determining at step S140 that bubbles have been generated, however, a step added to the predetermined logic or replacing at least a portion of the predetermined logic may be performed such that the washing cycle is performed and completed.

This may be a bubble reduction step or a step (S150) of preventing the generation of bubbles. The step of preventing the generation of bubbles may be a step newly added to the predetermined logic, and may be selectively performed only when bubbles have been generated.

Upon determining at step S140 that bubbles have been generated in the tub, the step (S150) of preventing the generation of bubbles is performed. That is, upon determining that bubbles have been generated in the washing cycle, a bubble reduction step is performed in the washing cycle.

The bubble reduction step is one of the steps performed in the washing cycle. Consequently, the drum is operated, and therefore washing is performed. Upon determining that bubbles have been generated, however, the drum may be operated in a manner different from the previous logic. That is, the magnitude of a stream of water may be reduced to reduce the amount of bubbles or to prevent the generation of additional bubbles.

For example, in the case in which the drum has been operated at a first rpm, which is relatively high, control may be performed such that the drum is operated at a second rpm, which is relatively low. In addition, in the case in which the unidirectional rotational motion, in which the magnitude of a stream of water is large, has been performed, control may be performed such that the unidirectional rotational motion is excluded afterward. Of course, in the case in which the unidirectional rotational motion has been performed at the first rpm, control may be performed such that a subsequent unidirectional rotational motion is performed at the second rpm, which is lower than the first rpm.

For example, at step S150, the drum may be rotated at an rpm at which the water in the tub moves upward along the inner circumferential surface of the tub but does not reach the upper surface of the tub in the washing cycle (S100).

The washing cycle (S100) may include a combination of the alternating rotational motion (S10) and the unidirectional rotational motion (S20). In a period in which the unidirectional rotational motion (S20) is performed, the maximum rotational speed of the drum may be limited to a fourth rpm, which is lower than the second rpm. Consequently, the generation of additional bubbles due to the unidirectional rotational motion (S20) is prevented. The fourth rpm may be lower than the third rpm, and may be about 40 rpm.

In some implementations, in the case in which bubbles are not sensed during the washing cycle, the washing cycle may be performed for 30 minutes, for example, according to a predetermined operation of the drum. During the washing cycle, bubbles may be sensed, and the remaining washing cycle time may be 15 minutes. As previously described, the magnitude of the stream of water when the drum is operated before bubbles are generated is relatively large. When the bubbles are generated, the magnitude of the stream of water according to subsequent operation of the drum is relatively small. As a result, the washing effect may be reduced. Upon determining that bubbles have been generated, therefore, the remaining washing cycle time may be increased. For example, in the case in which the remaining washing cycle time is 15 minutes, the washing cycle may be performed for 25 minutes. That is, 10 minutes may be added.

In the case in which the washing cycle is performed as described, sufficient washing force may be provided even when bubbles are generated. In addition, detergent or wash water is not removed, thereby providing sufficient washing force and preventing waste of wash water and detergent.

Figure 10:
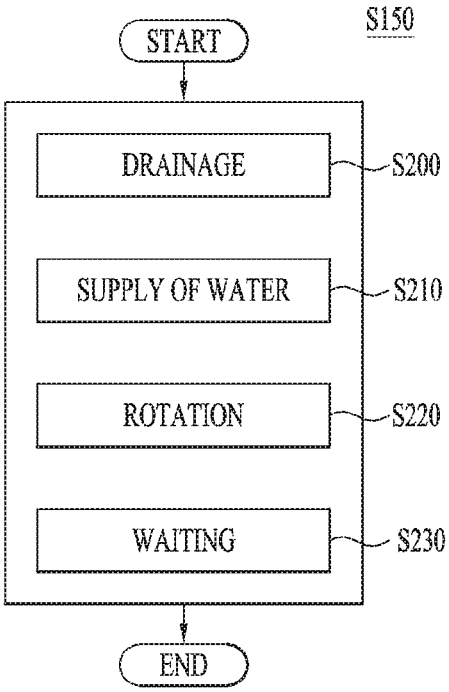
FIGS. 10 and 11 are flowcharts illustrating an example method for preventing bubbles in a laundry treatment apparatus.

FIG. 10 illustrates an example method for preventing bubbles in a laundry treatment apparatus.

FIG. 10 is a view showing another method of preventing the generation of bubbles in this example. A method of preventing the generation of bubbles or reducing the amount of bubbles will be described with reference to FIG. 10. For distinction, the previous bubble reduction step may be referred to as a first bubble reduction step, and the bubble reduction step in this example may be referred to as a second bubble reduction step (S150).

Step S150 may include a step (S200) of draining water from the tub, a step (S210) of supplying water into the tub 4, and a step (S220) of rotating the drum. In addition, step S150 may further include a step (S230) of performing waiting without draining water from the tub or supplying water into the tub. At the step (S210) of supplying water into the tub 4, water is sprayed to the upper surface of the drum through the spray unit 93. Consequently, water is directly sprayed to bubbles so as to remove the bubbles, and is drained through the drainage unit, which is provided at the lower side of the tub.

The drainage step (S200) and the water supply step (S210) may be simultaneously performed for a predetermined time. For example, the drainage step (S200) and the water supply step (S210) may be simultaneously performed, or the drainage step (S200), the water supply step (S210), and the drum rotating step (S220) may be simultaneously performed. Subsequently, waiting may be performed to stop the drainage, the spray, and the rotation. Such a combination of the drainage, the water supply, and the drum operation (rotation) may be referred to as a bubble reduction pattern. The bubble reduction pattern may further include additional drainage and waiting.

Particularly, in this example, a shower rinsing step, at which the drainage step (S200) and the water supply step (S210) are performed for a first predetermined time, the drainage step (S200) is performed for a second predetermined time, which is shorter than the first predetermined time, and the waiting step (S230) is performed for a third predetermined time, which is equal to the second predetermined time, may be included.

In addition, the bubble reduction pattern may be performed a plurality of times.

The second bubble reduction step (S150) may be performed after the washing cycle is completed. When the washing cycle is completed, a rinsing cycle is subsequently performed. In the rinsing cycle, the second bubble reduction step (S150) may be further performed. That is, upon determining that bubbles have been generated in the washing cycle, the bubble reduction step may be further performed in the rinsing cycle. In other words, the bubble reduction step may be performed in the washing cycle, and the bubble reduction step may be performed in the rinsing cycle. Consequently, the possibility of bubbles remaining after the washing course is completed may be further reduced.

When the washing cycle is completed, the step (S200) of draining water from the tub, the step (S210) of supplying water into the tub to a laundry rinsing level, and the step (S220) of rotating the drum may be performed. That is, the rinsing cycle may be performed. Upon determining that bubbles have not been generated in the washing cycle, intermediate spin drying is performed between the drainage and the water supply for rinsing.

If spin drying is performed in the state in which bubbles have not been removed, the amount of bubbles that are generated may be increased. For this reason, the second bubble reduction step may be performed before the intermediate spin drying is performed.

At the drainage step (S300), the water stored in tub for washing is drained. Subsequently, water is sprayed to the tub and the drum through the spray unit 93 in order to remove the bubbles, intermediate spin drying is performed, and water is supplied to a rinsing level, at which laundry is soaked. Consequently, the laundry in the drum is sufficiently soaked in the water, whereby most bubbles are removed.

Rinsing may be a bubble reduction step. That is, supplying a relatively large amount of wash water such that laundry is sufficiently soaked in the wash water and rotating the drum at a low speed may be a bubble reduction step. That is, bubbles may be reduced through sufficient rinsing, in other words, deep rinsing. Consequently, bubbles may be reduced by sequentially performing the supply of water, the rotation of the drum, and drainage, which may be referred to as a rinsing pattern.

The rinsing pattern and the bubble reduction pattern may be sequentially executed to reduce bubbles. For example, the bubble reduction pattern may be executed, the rinsing pattern may be executed, and the bubble reduction pattern may be executed again. That is, the bubble reduction step may be completed after the bubble reduction pattern is finally executed.

Figure 11:
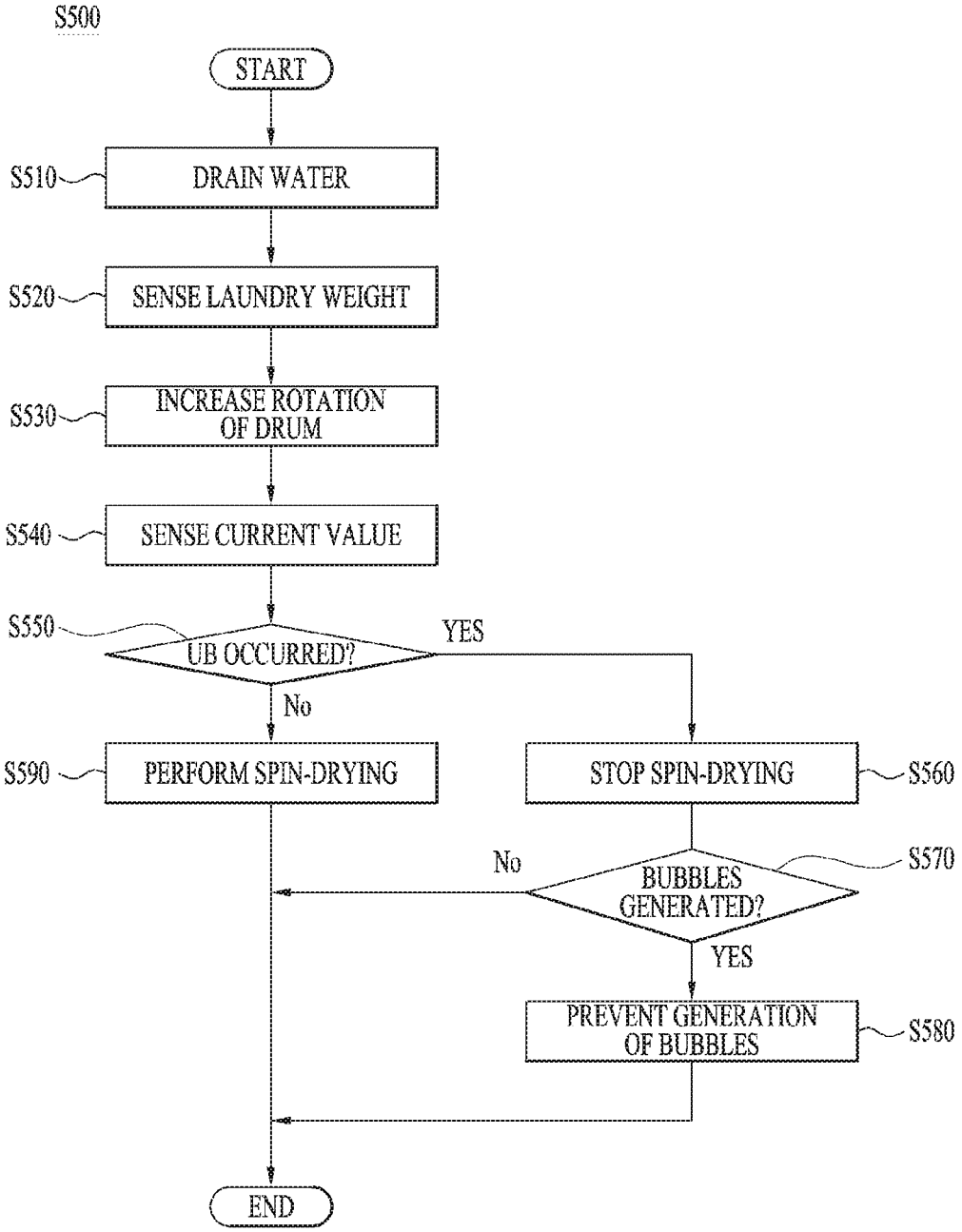

FIG. 11 illustrates an example method for preventing bubbles in a laundry treatment apparatus. In particular, the method can be a process of sensing bubbles generated during the spin-drying cycle and preventing the generation of bubbles in the method of controlling the laundry treatment apparatus. Sensing bubbles generated during the spin-drying cycle and preventing the generation of bubbles will be described with reference to FIG. 11.

The following description of the spin-drying cycle (S500) may equally apply to the normal spin-drying cycle (S500*a*) and the final spin-drying cycle (S500*b*), the difference between which will be described later.

The method of controlling the laundry treatment apparatus may include a step (S530) of increasing the rotational speed of the drum to a target rpm for spin drying and a step of measuring the value of current in the motor M to determine whether eccentricity has occurred and whether bubbles have been generated in the tub 4.

In a conventional method of controlling the laundry treatment apparatus, the current value is measured to determine whether eccentricity has occurred in the drum. However, the conventional method of controlling the laundry treatment apparatus has a problem in that, in the case in which bubbles have been generated in the tub and the drum, it may be erroneously determined that eccentricity has occurred in the drum even though the bubbles have been generated in the tub.

In the method of controlling the laundry treatment apparatus, whether eccentricity has occurred and whether bubbles have been generated are determined based on the measured current value.

For reference, the occurrence of eccentricity in the drum means the state in which laundry gathers at one side of the drum, whereby the distribution in mass of the drum is unbalanced. In this case, noise and vibration occur in the laundry treatment apparatus due to the rotation of the drum.

At the step (S530) of increasing the rotational speed of the drum to the target rpm for spin drying, the drum is rotated at a high speed in order to remove water from the laundry in the drum. When the drum is rotated at the high speed, the laundry stored in the drum clings to the inner circumferential surface of the drum due to centrifugal force, and water is discharged to the tub through the through holes formed in the drum.

As step S530, water is drained through the drainage unit 8 simultaneously with the rotation of the drum. Consequently, the water separated from the laundry by the high-speed rotation of the drum is drained from the tub.

In addition, a step (S510) of draining water from the tub may be performed before step S530.

The spin-drying cycle (S500) is performed after the washing cycle (S100) or the rinsing cycle (S300). The reason for this is that it is necessary to perform the step (S510) of draining water from the tub before rotating the drum at the target rpm for spin drying, since wash water is stored in the tub in any case.

In some implementations, a step (S520) of sensing the weight of wet laundry in the drum (hereinafter, referred to as "wet laundry weight") may be performed between the drainage step (S510) and the step (S530) of increasing the rotational speed of the drum to the target rpm. Consequently, the target rpm for spin drying may be set depending on the sensed wet laundry weight.

Figure 12:
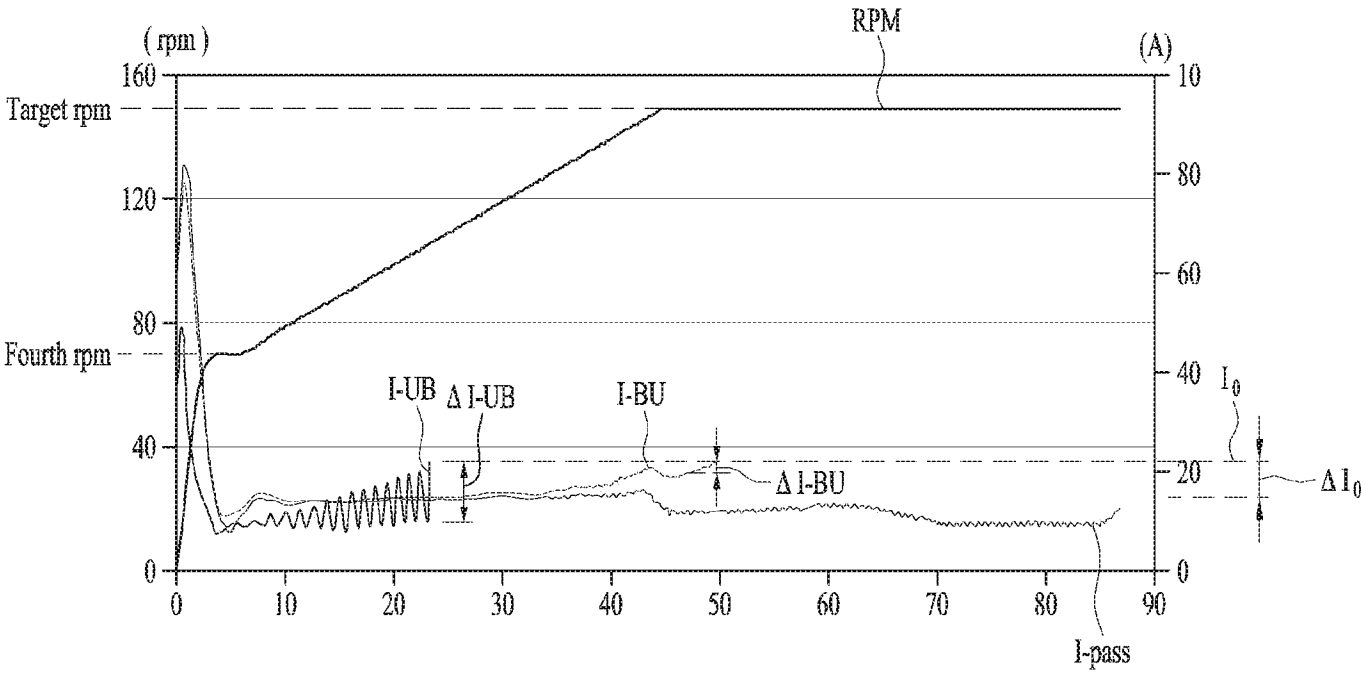
FIG. 12 is a graph illustrating an example rotational speed of a drum and an example value of current measured in a motor.

FIG. 12 illustrates an example rotational speed of a drum and an example value of current measured in a motor. Hereinafter, a step (S540) of measuring the value of current measured in the motor M, a step (S550) of determining whether eccentricity has occurred, and a step (S570) of determining whether bubbles have been generated in the tub 4 will be described.

The drum 5 is connected to the shaft M3 of the motor M. The shaft M3 is connected to the rotor M2. The rotor M2 is rotated by a magnetic field generated by the stator M1, which is fixed to the rear surface of the tub 4. The rotational speed of the drum may be changed depending on the value of current supplied to the stator M1. The value of current supplied to the stator may be measured by a current sensing unit 103.

The current sensing unit 103 may be provided at the stator M1 or at a power line for supplying power to the stator M1 (see FIG. 2).

Referring to FIG. 12, "RPM" indicates the current rotational speed of the drum, and "I-pass" indicates the value of current measured in the case in which eccentricity has not occurred in the drum. In order to rotate the stopped drum 5, a large amount of current must be supplied to the motor such that the motor can be rotated while overcoming static frictional force. When the rotational speed of the drum reaches a predetermined fourth rpm, the drum performs a constant angular velocity motion. Even when only uniform torque is supplied, therefore, the rotational speed of the drum is increased. As a result, the current supplied to the motor is abruptly decreased. Even when only a small amount of current is supplied, the rotational speed of the drum is increased to the target rpm.

The reason for this is that the controller 101 performs the feedback control of a hall sensor 104 and the motor M. The hall sensor 104 is provided at the lower surface of the tub or at the stator M1. The hall sensor 104 senses a magnet provided in the rotor M2 during the rotation of the rotor M2 to measure the rotational speed of the drum.

For example, the controller 101 may perform control such that a predetermined value of current is supplied to the motor in order to rotate the drum at a specific rpm. In the case in which the rpm of the drum sensed by the hall sensor 104 has not reached the specific rpm, however, the controller 101 performs control such that a value of current greater than the predetermined value of current is supplied to the motor. The reason for this is that, when the value of current supplied to the stator M1 is increased, the generated magnetic field is increased, whereby the rotational speed of the drum is increased. On the other hand, upon determining that the rotational speed of the drum sensed by the hall sensor 104 is high, the controller 101 reduces the value of current supplied to the motor to decrease the rotational speed of the drum 5.

In the case in which eccentricity has occurred in the drum or in the case in which bubbles have been generated in the tub and the drum, the value of instantaneous current supplied to the motor is increased.

In the case in which eccentricity has occurred in the drum, the distribution in mass of the drum is not uniform. Since torque is high at the heavy side of the drum, it is instantaneously determined that the rotational speed of the drum sensed by the hall sensor 104 is high, and the controller 101 performs control such that a low value of current is supplied to the motor M. Since torque is low at the light side of the drum, on the other hand, it is instantaneously determined that the rotational speed of the drum sensed by the hall sensor 104 is low, and the controller 101 performs control such that a high value of current is supplied to the motor M. In the case in which the value of current supplied to the motor is measured as a high value, therefore, the measured value of instantaneous current appears high. That is, in the case in which eccentricity has occurred, the magnitude of fluctuation of the measured value of current appears high. In the case in which eccentricity has occurred in the drum, the value of current measured in the motor appears as I-UB (unbalance), as shown in FIG. 12.

In some implementations, in the case in which bubbles have been generated in the tub and the drum, bubbles between the tub and the drum act as frictional force that disturbs the rotation of the drum when the drum is rotated fast in the tub. Since bubbles are uniformly generated on the outer circumferential surface and the inner circumferential surface of the drum, frictional force is applied to the entire surface of the drum due to predetermined bubbles, and the distribution in mass of the drum is uniform. When the rotational speed of the drum is increased and thus the amount of bubbles that are generated is increased, therefore, the frictional force of the bubbles is increased, and the rotational speed of the drum sensed by the hall sensor 104 is reduced. Consequently, the controller 101 must supply a higher value of current to the motor. In the case in which bubbles have been generated in the drum, the value of current measured in the motor appears as I-BU (bubbles), as shown in FIG. 12.

The value of current in the motor M is measured (S540). Upon determining, at the step of determining whether eccentricity has occurred and whether bubbles have been generated in the tub, that eccentricity has not occurred, a step (S590) of rotating the drum at the target rpm to perform spin drying is performed.

When the value of current measured in the motor reaches a predetermined current value Io, it is determined that eccentricity has occurred in the drum. In this case, the rotation of the drum is stopped to interrupt spin drying (S560).

Subsequently, in the case in which the spin-drying cycle (S500) is the normal spin-drying cycle (S500*a*), the rinsing cycle (S300) is performed. That is, a water supply step is performed. In the case in which the spin-drying cycle (S500) is the final spin-drying cycle (S500*b*), a laundry untangling cycle is performed to untangle the laundry gathered at one side of the drum.

As previously described, however, it is necessary to determine whether the value of current measured in the motor, which has reached the predetermined current value Io, is based on eccentricity or bubbles.

The step of measuring the value of current in the motor M to determine whether eccentricity has occurred and whether bubbles have been generated in the tub may include a step (S570) of determining whether bubbles have been generated in the tub and a step (S580) of preventing the generation of bubbles.

At the step (S570) of determining whether bubbles have been generated in the tub and the step (S580) of preventing the generation of bubbles, the magnitude of fluctuation of the measured current value is compared with the magnitude of fluctuation ΔIo of the predetermined current value to determine whether bubbles have been generated in the tub. Specifically, in the case in which the magnitude of fluctuation of the measured current value is greater than the magnitude of fluctuation ΔIo of the predetermined current value, it is determined that eccentricity has occurred, and, in the case in which the magnitude of fluctuation of the measured current value is less than the magnitude of fluctuation ΔIo of the predetermined current value, it is determined that bubbles have been generated.

For example, when eccentricity has occurred in the drum, the magnitude of fluctuation ΔI-UB of the measured current value is greater than the magnitude of fluctuation ΔIo of the predetermined current value, as shown in FIG. 12. When eccentricity has occurred in the drum, the magnitude of fluctuation ΔI-UB of the measured current value may be the different in height from a low point before the measured current value reaches the predetermined current value Io, or may be the average of one or more magnitudes of fluctuation.

On the other hand, when bubbles have been generated in the drum, the magnitude of fluctuation ΔI-BU of the measured current value is less than the magnitude of fluctuation ΔIo of the predetermined current value.

In some implementations, the step (S580) of preventing the generation of bubbles may equally apply to the step (S150) of preventing the generation of bubbles in rinsing. That is, when bubbles are sensed during the normal spin-drying process or the intermediate spin-drying process, spin drying may be stopped and the second bubble reduction step may be performed. Subsequently, the rinsing cycle may be performed.

In addition, when bubbles are sensed during the final spin-drying process, spin drying may be stopped and the second bubble reduction step may be performed. Subsequently, final spin drying may be resumed.

Figure 13:
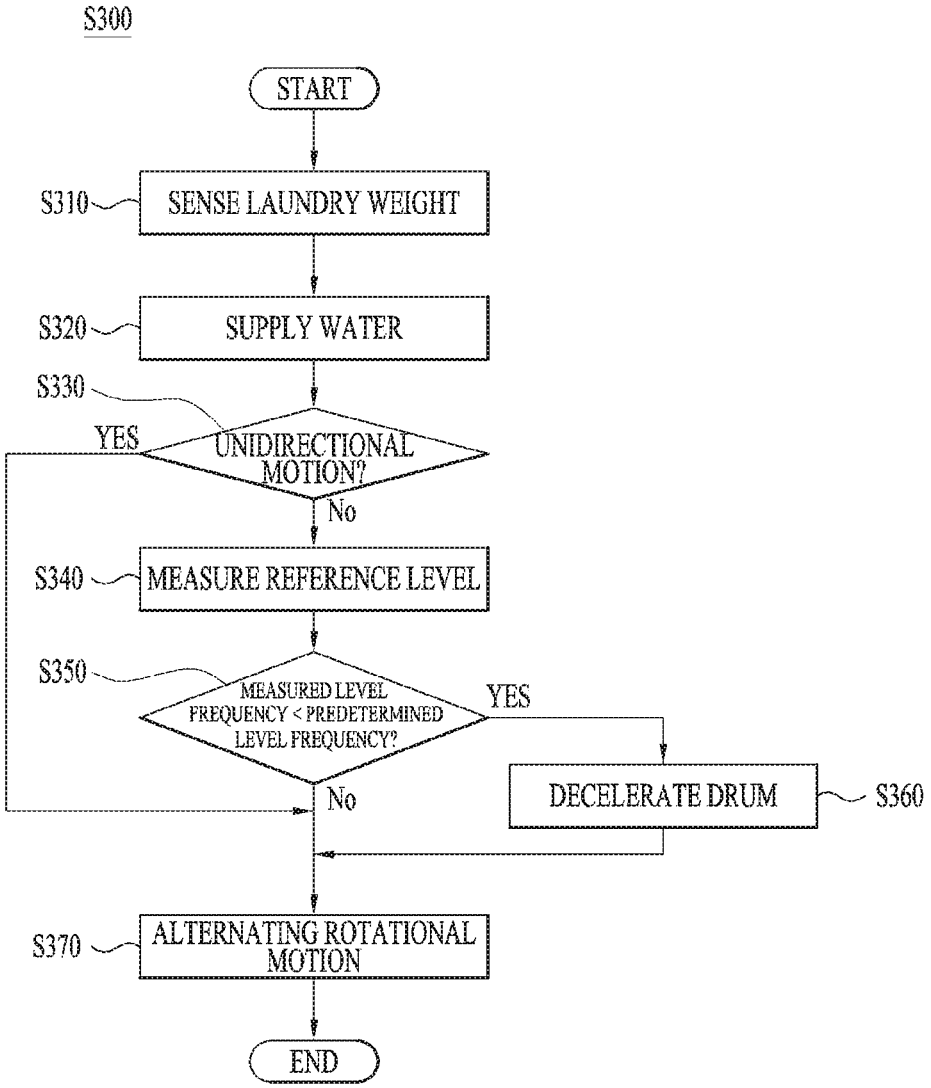
FIG. 13 is a flowchart illustrating an example method for controlling a laundry treatment apparatus.
Figure 14:
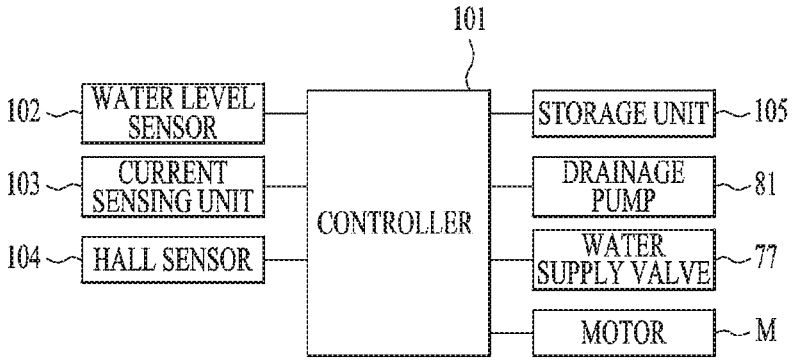
FIG. 14 is a diagram illustrating an example laundry treatment apparatus.

FIG. 13 illustrates an example method for controlling a laundry treatment apparatus.

As previously described, the laundry treatment apparatus includes the tub 4, which is provided in the upper surface thereof with the introduction port 431, through which laundry is introduced, the door 45, which is configured to open and close the introduction port 431, and the drum 5, which is rotatably provided in the tub 4.

The height of the tub 4 and the drum 5 is smaller than the diameter of the tub 4 and the drum 5. When the drum 5 is rotated, therefore, a steam of water moving upward/downward from the tub 4 frequently contacts the upper surface of the tub, with the result that a large amount of bubbles are generated. For this reason, the upper surface of the tub 4 is closed to seal the tub 4, unlike a general laundry treatment apparatus.

When washing is completed in the state in which bubbles generated during the washing cycle (S100) or the spin-drying cycle (S500) remain on the upper surface of the tub or the door 45, the user may misjudge that washing has not been sufficiently performed. As a result, washing may be performed again, resulting in increased time and energy consumption.

In this example, a step (S320) of supplying water into the tub 4 and a step (S340) of rotating the drum 5 in one direction such that wash water in the tub 4 moves upward along the inner surface of the tub 4 and reaches the center of the upper surface of the tub 4 may be included.

This example may be performed together with the second bubble reduction step. This example may be performed while the rinsing pattern is performed in the rinsing cycle. In addition, this example may be performed after a bubble removal pattern is performed. Consequently, it is possible to prevent the deterioration of user satisfaction due to bubbles remaining on the door, even though bubbles do not remain on the laundry.

That is, even when foreign matter, such as bubbles, is attached to the upper surface of the tub 4, the entirety of the upper surface of the tub 4 may be washed by a stream of water moving upward from the bottom surface of the tub 4. Furthermore, bubbles on the door 45 of the laundry treatment apparatus may be removed by washing.

The laundry treatment apparatus is different from a conventional laundry treatment apparatus as follows. In the conventional laundry treatment apparatus, the upper surface of the tub 4 is open. Even when the drum 5 is rotated in one direction such that water stored in the tub 4 moves upward along the inner surface of the tub 4, therefore, the water stored in the tub 4 reaches the upper side of the inner surface of the tub 4, but a stream of water does not reach the center of the upper surface of the tub 4. In this example, however, the upper surface of the tub 4 is closed, with the result that the water stored in the tub 4 reaches the upper surface of the tub 4.

In some implementations, a step (S310) of sensing a load in the drum 5 before supplying water to the tub 4 may be included. Consequently, the amount of laundry in the drum 5 may be sensed to adjust the amount of water to be supplied to the tub or to control the rotational speed of the drum.

In some implementations, before the step (S310) of sensing the load in the drum 5, the drum is rotated at a high speed for spin drying in order to drain water from the tub 4 or remove water from the laundry. Consequently, the load in the drum 5 sensed at the step (S310) of sensing the load in the drum 5 is the sum of the weight of the drum itself and the weight of the spin-dried laundry.

The level of water supplied to the tub at the step (S320) of supplying water into the tub 4 is set depending to the washing course or the sensed load in the drum.

For example, the amount of water supplied to the tub 4 may be in inverse proportion to the load in the drum. This is meaningful in the case in which the maximum level of the water that can be stored in the tub 4 is limited since the height of the tub is smaller than the diameter of the tub. That is, in order to uniformly maintain the level of water in the tub 4 at a time at which the supply of water to the tub 4 is completed, the amount of water to be supplied is increased when the amount of laundry in the drum is small, and the amount of water to be supplied is decreased when the amount of laundry in the drum is large.

In some implementations, the method of controlling the laundry treatment apparatus may include a step (S330) of determining whether a motion of rotating the drum in one direction such that wash water in the tub moves upward along the inner surface of the tub and falls into the drum through the open surface of the drum has been performed in the washing cycle.

In this case, the step (S340) of rotating the drum 5 in one direction such that the wash water in the tub 4 moves upward along the inner surface of the tub 4 and reaches the center of the upper surface of the tub 4 may be performed when the motion of rotating the drum in one direction such that the wash water in the tub moves upward along the inner surface of the tub and falls into the drum through the open surface of the drum has been performed. That is, step S340 may be performed when it is determined at step S330 that the unidirectional rotational motion has been previously performed.

The motion of rotating the drum in one direction such that the wash water in the tub moves upward along the inner surface of the tub and falls into the drum through the open surface of the drum is defined as the unidirectional rotational motion (S20). The unidirectional rotational motion (S20) may be combined with the alternating rotational motion (S10) in the washing cycle (S100).

When the unidirectional rotational motion (S20) is performed, water in the tub 4 instantaneously moves upward along the inner surface of the tub 4, reaches the edge of the upper surface of the tub 4, and falls to the laundry through the upper open surface 53 of the drum.

In particular, when the unidirectional rotational motion (S20) is performed during the washing cycle, a large amount of bubbles are generated in the tub 4 by water moving upward and downward, and the generated bubbles are attached to the upper surface of the tub or to the door 45. When the unidirectional rotational motion (S20) is performed, therefore, the step (S340) of rotating the drum 5 in one direction such that the wash water in the tub 4 moves upward along the inner surface of the tub 4 and reaches the center of the upper surface of the tub 4 is performed to remove the bubbles from the upper surface of the tub or from the door.

In some implementations, the method of controlling the laundry treatment apparatus may include a step (S350) of, upon determining that the level frequency measured to sense the level of water in the tub is lower than a predetermined level frequency, reducing the rotational speed of the drum.

The drum deceleration step (S350) may be performed after step S340 is commenced.

In the case in which the measured level frequency is lower than the predetermined level frequency stored in the storage unit 105, it may be considered that the level of water in the tub 4 has been increased, and therefore the pressure in the tub has been increased.

The predetermined level frequency is a critical value of the level frequency at which the level of water in the tub 4 or the pressure in the tub 4 is increased with the result that the door 45, which closes the introduction port 431 of the tub 4, is opened or water leaks from the gap between the door and the tub, or a value less than the critical value.

In other words, when the measured level frequency becomes lower than the predetermined level frequency, the door 45 may be opened, or water may leak immediately or within a few seconds. Upon determining that the level frequency measured at step S350 is lower than the predetermined level frequency, therefore, the rotational speed of the drum is immediately reduced to lower the level of water in the tub and the pressure in the tub (S360).

In some implementations, in the case in which there is no load in the drum at the step (S340) of rotating the drum 5 in one direction such that the wash water in the tub 4 moves upward along the inner surface of the tub 4 and reaches the center of the upper surface of the tub 4, the rotational speed of the drum is higher than in the case in which there is a load in the drum.

The reason for this is that, in the case in which there is no laundry, i.e. no load, in the drum, a stream of water must be generated using only water without laundry such that the water moves upward from the bottom surface to the upper surface of the tub, and thus the rotational speed of the drum must be the highest, whereas in the case in which there is laundry, i.e. a load, in the drum, the laundry in the drum pushes water outward with the result that a stream of water easily moves upward from the bottom surface to the upper surface of the tub even when the drum is rotated at a lower rpm than in the case in which there is no load in the drum.

In the case in which there is a load in the drum at the step (S340) of rotating the drum 5 in one direction such that the wash water in the tub 4 moves upward along the inner surface of the tub 4 and reaches the center of the upper surface of the tub 4, the rotational speed of the drum is increased as the load in the drum is increased.

As the amount of laundry in the drum and the amount of water stored in the tub is increased, the load in the drum is increased. Consequently, the drum must be rotated at a higher rpm such that the laundry and the water reach the upper surface of the tub.

Even in the case in which there is the same load in the drum, it is possible to generate a stream of water that can reach the center of the upper surface of the tub even though the rotational speed of the drum is reduced when the level of water in the tub is high or when the amount of water is larger than the amount of laundry.

In some implementations, the step (S320) of supplying water into the tub 4 and the step (S340) of rotating the drum 5 in one direction such that the wash water in the tub 4 moves upward along the inner surface of the tub 4 and reaches the center of the upper surface of the tub 4 may be performed in the rinsing cycle (S300).

The water supply step is essentially required to rinse laundry. Consequently, step S340 may be performed after the water supply step in order to rinse the laundry and, at the same time, to wash the upper surface of the tub.

As previously described, the laundry treatment apparatus may be an auxiliary laundry treatment apparatus that is coupled to a main laundry treatment apparatus. For example, a general washing apparatus may be referred to as a first washing apparatus, and a washing apparatus may be referred to as a second washing apparatus. In this case, the first washing apparatus and the second washing apparatus may constitute a single laundry treatment apparatus. The first washing apparatus and the second washing apparatus may be separately manufactured so as to be capable of being coupled to each other. The second washing apparatus may be disposed on or under the first washing apparatus.

Hereinafter, an example of a laundry treatment apparatus including a first washing apparatus and a second washing apparatus provided in a single cabinet will be described. The basic features of the second washing apparatus may be identical to those of the previous example. That is, since the height and volume of the second washing apparatus are smaller than those of the first washing apparatus, the possibility of bubble generation is high, and it is critical to prevent the generation of bubbles.

Figure 15:
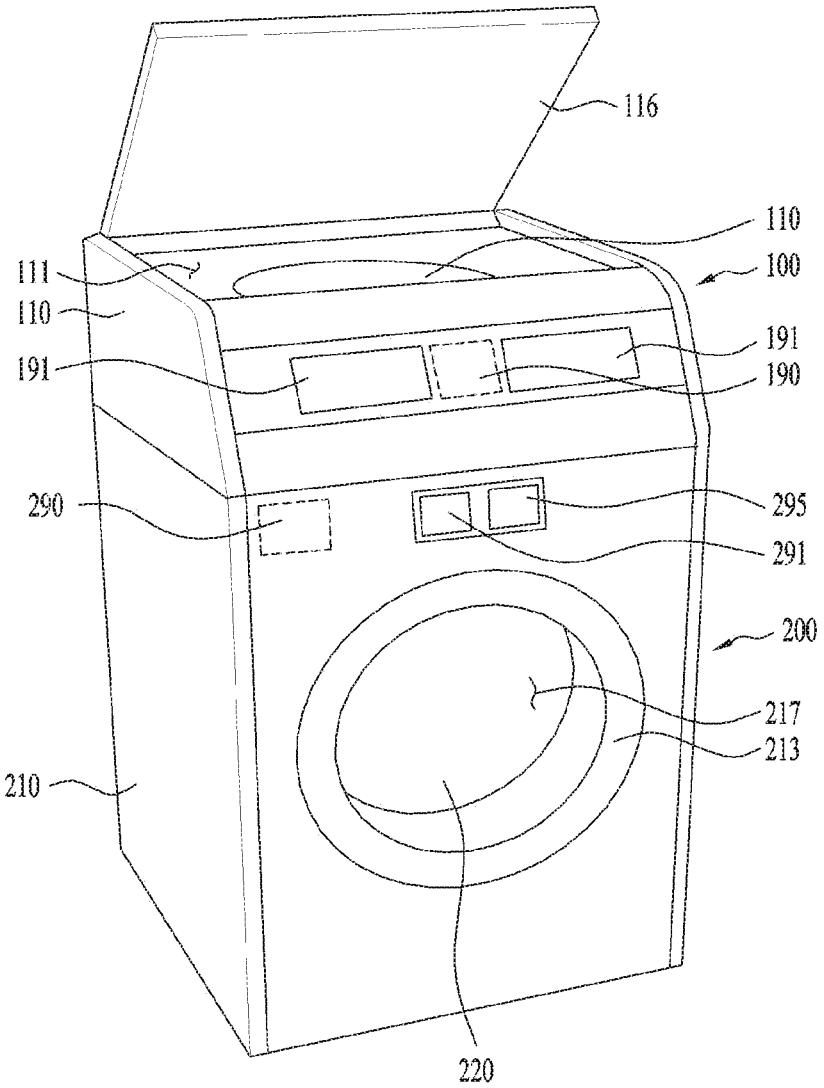
FIGS. 15 and 16 are diagrams illustrating an example laundry treatment apparatus.
Figure 16:
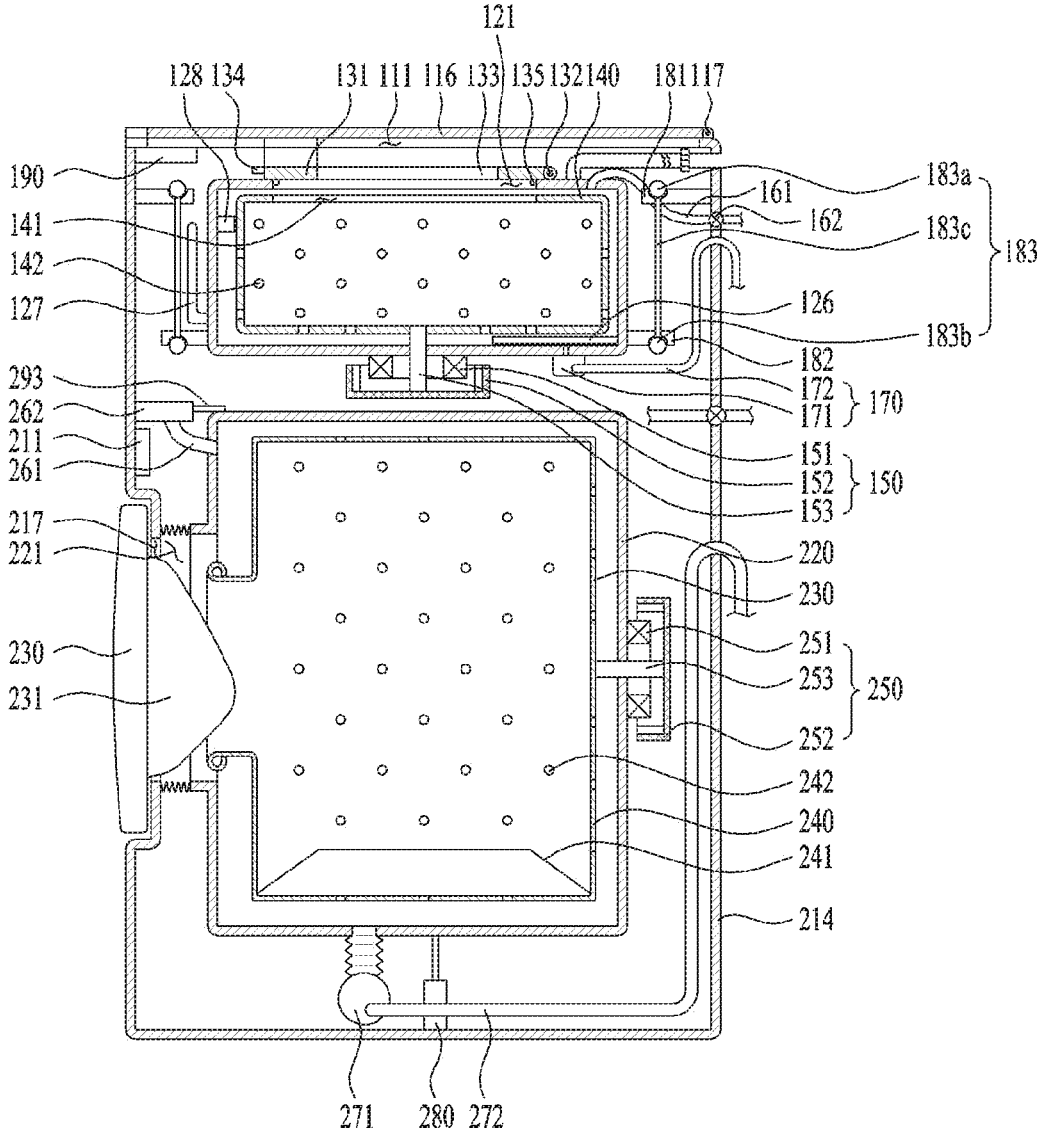

FIGS. 15 and 16 illustrate an example laundry treatment apparatus. As shown in FIGS. 15 and 16, another example laundry treatment apparatus includes a front loading type laundry treatment apparatus 200 and a top loading type laundry treatment apparatus 100 disposed on the front loading type laundry treatment apparatus.

The top loading type laundry treatment apparatus 100 may be integrally coupled to the front loading type laundry treatment apparatus 200.

The front loading type laundry treatment apparatus is a laundry treatment apparatus configured such that an opening is provided in the front of the laundry treatment apparatus and such that the shaft of a drum is parallel to the ground or inclined from the ground by a predetermined angle, and the top loading type laundry treatment apparatus is a laundry treatment apparatus configured such that an opening is provided in the top of the laundry treatment apparatus and such that the shaft of a drum is perpendicular to the ground.

The front loading type laundry treatment apparatus 200 may be defined as a first laundry treatment apparatus, and the top loading type laundry treatment apparatus 100 may be defined as a second laundry treatment apparatus.

The laundry treatment apparatus may be configured such that the front loading type laundry treatment apparatus 200 and the top loading type laundry treatment apparatus 100 are separately provided, such that the front loading type laundry treatment apparatus 200 and the top loading type laundry treatment apparatus 100 are coupled to each other, or such that the front loading type laundry treatment apparatus 200 and the top loading type laundry treatment apparatus 100 are integrated.

The laundry treatment apparatus may include a first cabinet 210 having a first opening 217 formed in the front thereof, a first laundry receiving unit 220 and 240 provided in the first cabinet 210 for receiving laundry, a second cabinet 110 provided on the first cabinet 210, the second cabinet 110 having a second opening 111 formed in the top thereof, and a second laundry receiving unit 120 and 140 provided in the second cabinet 110 for receiving laundry. The second laundry receiving unit 120 and 140 may be a drum, which may be rotatably provided in a tub 4.

The first cabinet 210 may define the external appearance of the first laundry treatment apparatus 200, and the second cabinet 110 may define the external appearance of the second laundry treatment apparatus 100.

In addition, the first cabinet 210 and the second cabinet 110 may be coupled to each other to define the entire external appearance of the laundry treatment apparatus.

The first cabinet 210 may be provided at the front thereof with a first display unit 295 for displaying the state of the first laundry treatment apparatus 200, a first input unit 291 for allowing an operation command of the first laundry treatment apparatus 200 to be input, and a first controller 290 for controlling the operation of the first laundry treatment apparatus 200.

In addition, the second cabinet 110 may be provided at the top thereof with a second display unit 195 for displaying the state of the second laundry treatment apparatus 100, a second input unit 191 for allowing an operation command of the second laundry treatment apparatus 100 to be input, and a second controller 190 for controlling the operation of the second laundry treatment apparatus 100.

In the case in which the second laundry treatment apparatus 100 is coupled to the upper part of the first laundry treatment apparatus 200 or in the case in which the first laundry treatment apparatus 200 and the second laundry treatment apparatus 100 are integrated, one selected from between the first controller 290 and the second controller 190 may control both the first laundry treatment apparatus and the second laundry treatment apparatus.

In addition, operation commands may be input to both the first laundry treatment apparatus and the second laundry treatment apparatus through the first input unit 291, or operation commands may be input to both the first laundry treatment apparatus and the second laundry treatment apparatus through the second input unit 191.

Each of the first display unit 295 and the second display unit 195 may include a panel, such as an LCD panel or an LED panel. In addition, each of the first display unit 295 and the second display unit 195 may include a speaker for outputting a sound to provide a user with information.

That is, the first display unit 295 and the second display unit 195 may display information about the laundry treatment apparatuses, and an alarm may be output to provide the user with information.

In some implementations, the first laundry treatment apparatus 200 may be configured as a washing apparatus for washing laundry using detergent and water or as a drying apparatus for drying laundry using hot air.

In the case in which the first laundry treatment apparatus 200 is configured as a washing apparatus, the first laundry receiving unit 220 and 240 may include a first tub 220 having a first introduction port 221 that communicates with the first opening 217 and providing space for storing water and a first drum 240 rotatably provided in the first tub 220 for receiving laundry.

In the case in which the first laundry treatment apparatus 200 is configured as a drying apparatus, the first laundry receiving unit 220 and 240 may include a first drum 240 rotatably provided in the first cabinet 210 for receiving laundry.

FIGS. 15 and 16 show the case in which the first laundry treatment apparatus 200 is configured as a washing apparatus. However, the case in which the first laundry treatment apparatus 200 is configured as a drying apparatus is not excluded.

In addition, the second laundry treatment apparatus 100 may be configured as a washing apparatus for washing laundry using detergent and water or as a drying apparatus for drying laundry using hot air.

In the case in which the second laundry treatment apparatus 100 is configured as a washing apparatus, the second laundry receiving unit 120 and 140 may include a second tub 120, having a second introduction port 121 that communicates with the second opening 111 and providing space for storing water, and a second drum 140, rotatably provided in the second tub 120 for receiving laundry.

A water level sensor 127 for sensing the level of water in the second tub 120 may be provided at one side of the second tub 120, and a temperature sensor 128 for sensing the temperature of the second tub 120 may be provided at the inner circumferential surface of the second tub 120.

In the case in which the second laundry treatment apparatus 100 is configured as a drying apparatus, the second laundry receiving unit 120 and 140 may include a second drum 140 rotatably provided in the second cabinet 110 for receiving laundry.

FIGS. 15 and 16 show the case in which the second laundry treatment apparatus 100 is configured as a washing apparatus. However, the case in which the second laundry treatment apparatus 100 is configured as a drying apparatus is not excluded.

The first laundry treatment apparatus 200 may include a first door 230 for opening and closing the first opening 210. The first door 230 may include a door gasket 231 for sealing the first introduction port 221 formed in the first tub 220 when the first opening 210 is closed.

In some implementations, the first laundry treatment apparatus 200 may include a first water supply unit 260 for supplying water to the first tub 220 and a first drainage unit 270 for draining water from the first tub 220.

The first water supply unit 260 may include a first water supply pipe 261 for supplying water from an external water supply source to the first tub 220, a detergent box 220 for mixing detergent with the water supplied to the first water supply pipe 261 and supplying the mixture to the first tub 220, and a first supply pipe 263 connecting the detergent box 220 to the first tub 220 for supplying the water and the detergent to the first tub 220.

The first drainage unit 270 may include a first drainage pipe 272 provided under the first tub 220 for draining water from the first tub 220 and a first drainage pump 271 for draining water in the first drainage pipe 272 out of the first cabinet 210.

In some implementations, the first laundry treatment apparatus 200 may include a supporting and damping unit 280 for supporting the first tub 220 in the first cabinet 210 and damping vibration generated from the first tub 220 such that the vibration is not transmitted to the first cabinet 210.

The supporting and damping unit 280 may be configured as a damper, a spring, or a combination thereof. A plurality of supporting and damping units may be provided.

A supporting and damping unit 280 may be provided at the upper part or the lower part of the first tub 220, or supporting and damping units 280 may be provided at the upper part and the lower part of the first tub 220.

In some implementations, the first laundry treatment apparatus 200 may include a first driving unit 250 for rotating the first drum 230.

The first driving unit 250 may include a first stator 251 provided at the rear surface of the first tub 220 for generating a rotating magnetic field, a first rotor 252 configured to be rotated by the rotating magnetic field generated by the first stator 251, and a shaft 253 having one end connected to the first rotor 252 and the other end extending through the first tub 220 so as to be connected to the first drum 240.

The shaft 252 may be configured to be parallel to the ground or to be inclined upward from the ground.

The first drum 240 may include a lifter 241 for lifting and dropping laundry when the first drum 240 is rotated to improve washing performance. In addition, the first drum 240 may be provided in the inner circumferential surface thereof with a plurality of through holes 242 through which water is introduced or discharged.

In some implementations, the height of the second laundry treatment apparatus 100 is limited, since the second laundry treatment apparatus 100 is disposed on the first laundry treatment apparatus 200. That is, if the second laundry treatment apparatus 100 is higher, the washing capacity of the second laundry treatment apparatus 100 is further increased; however, it is difficult for a user to access the second opening 111.

As a result, the second tub 120 is relatively low, with the result that water or laundry received in the second tub 120 may be discharged out of the second tub 120.

For this reason, the second tub 120 may include a tub door 130 for opening and closing the second introduction port 121. The tub door 120 closes the second introduction port 121 to prevent water or laundry received in the second tub 120 from being discharged out of the second tub 120.

The tub door 130 may be hingedly provided at the top of the second tub 120.

The tub door 130 may include a frame 131 hingedly coupled to the second tub via a door hinge 132, a window 133 provided in the frame, and a door handle 134 for separably coupling the frame 131 to the second tub 120.

The window 133 may be made of a transparent material such that a user can check the interior of the second tub 120.

In some implementations, in order to prevent the water in the second tub 120 from being discharged out of the second tub 120 through the second introduction port 121, a sealing part 135 for sealing the space between the frame 131 and the second introduction port 121 when the tub door 130 closes the second introduction port 121 may be provided at one selected from between the frame 131 and the inner circumferential surface of the second introduction port 121.

The second laundry treatment apparatus 100 may include a second water supply unit 160 for supplying water to the second tub 120 and a second drainage unit 170 for draining water from the second tub 120.

The second water supply unit 160 may include a second water supply pipe 161 for supplying water from an external water supply source to the second tub 120 and a water supply valve 162 for adjusting the flow rate in the second water supply pipe 161.

The second drainage unit 170 may include a second drainage pipe 172 provided under the second tub 120 for draining water from the second tub 120 and a second drainage pump 171 communicating with the second drainage pipe 172 for draining water in the second drainage pipe 172 out of the second cabinet 110.

The second water supply unit 160 and the second drainage unit 170 may be provided separately from the first water supply unit 260 and the first drainage unit 270, respectively.

The second water supply unit 160 and the second drainage unit 170 may be integrally formed with the first water supply unit 260 and the first drainage unit 270, respectively, or may diverge from the first water supply unit 260 and the first drainage unit 270, respectively.

The reasons for this are that the second laundry treatment apparatus 100 may be separably coupled to the first laundry treatment apparatus 200 or the second laundry treatment apparatus 100 and that the first laundry treatment apparatus 200 may be independently provided.

The top of the second cabinet 110 may be defined by a cover door 116. The cover door 116 may be hingedly provided at one side of the second cabinet 110. The cover door 116 may be hingedly coupled to the second cabinet 110 via a cover hinge 117. The cover hinge 117 may be provided at one side of the cover door 116.

The second drum 140 may include a drum introduction port 141 communicating with the second introduction port 111. In addition, the second drum 140 may be provided in the inner circumferential surface thereof with a plurality of through holes 142, through which water is introduced from or discharged to the second tub 120.

In some implementations, the second laundry treatment apparatus 100 may include a second driving unit 150 for rotating the second drum 140 in the second tub 120.

The second driving unit 150 may include a second stator 151 fixed to the lower surface of the second tub 120 for generating a rotating magnetic field, a second rotor 152 configured to be rotated by the rotating magnetic field generated by the second stator 151, and a shaft 153 having one end connected to the second rotor 152 and the other end extending through the second tub 120 so as to be connected to the second drum 140.

In some implementations, although not shown, the second laundry treatment apparatus 100 may include a heater 126 for heating the water stored in the second tub 120.

In addition, the second laundry treatment apparatus 100 may include a temperature sensor 128 for measuring the temperature of the second tub 120 and a water level sensor 127 for sensing the level of water in the second tub 120.

In some implementations, the second laundry treatment apparatus 100 may include a cover door 116 for opening and closing the second opening 111.

The reason for this is that, if the second water supply unit 160, the second drainage unit 170, and the second driving unit 150, which are provided in the second cabinet 110 and the second tub 120, are exposed to the outside, the aesthetic appearance of the second laundry treatment apparatus is deteriorated and a safety-related accident may occur.

In some implementations, the second laundry treatment apparatus 100 may include a support unit 180 for supporting the second tub 120 in the second cabinet 110.

The support unit 180 may include a first support part 181 provided at the second cabinet 110, a second support part 182 provided at the second tub 120, and a connection part 183 for connecting the first support part 181 and the second support part 182 to each other.

The first support part 181 is provided higher than the second support part 182. One end of the connection part 183 is coupled and fixed to the first support part 181, and the other end of the connection part 183 supports the second support part 182 such that the second tub 120 is fixed in the second cabinet 110.

The first support part 181 may be configured as a first bracket protruding from the second cabinet 110. The second support part 182 may be configured as a second bracket protruding from the second tub 120. The connection part 183 may connect the first bracket and the second bracket to each other. The connection part 183 may be configured to be perpendicular to the ground.

Consequently, the volume of the support unit 180, including the connection part 183, may be minimized, whereby the washing capacity of the second tub 120 may be further increased.

The connection part 183 may include a first connection part 183*a* extending through the first support part 281 so as to be located in the first support part 281, a second connection part 183*b* extending through the second support part 182 so as to support the second support part 182, and a connection bar 183*c* for connecting the first connection part 183*a* and the second connection part 183*b* to each other.

The diameter of the first connection part 183*a* and the second connection part 183*b* may be greater than that of the connection part 183*c*. The first connection part 183*a* and the second connection part 183*b* may be formed in the shape of a disc, a hemisphere, or a sphere. Consequently, the connection part 183 may be stably coupled to the first support part 181 and to the second support part 182.

The examples described above not limited, and various modifications and variations can be made to the examples.

What is claimed is:

1. A method of controlling a laundry treatment apparatus that includes a cabinet including a first opening and a second opening, a first cabinet door that is coupled to the cabinet and that is configured to open or close the first opening, a second cabinet door that is coupled to the cabinet and that is configured to open or close the second opening, a first washing apparatus that is located in the cabinet and that is configured to treat laundry introduced into an interior area of the first washing apparatus through the first cabinet door in a first direction, and a second washing apparatus that is configured to treat laundry introduced into an interior area of the second washing apparatus through the second cabinet door in a second direction, the second washing apparatus including a tub that is accessible through the second opening in a state in which the second cabinet door is opened, that is configured to store water, and that includes a tub opening at a top of the tub, a tub cover that is coupled to the tub, that covers the tub opening, and that includes an introduction port through which laundry is introduced into the interior area of the second washing apparatus, a tub door that is coupled to the tub cover, that is configured to open or close the introduction port, and that is independently operated of the second cabinet door, a drum that is located in the tub and that is configured to rotate about a shaft, the shaft extending in the second direction, a spray unit configured to spray water toward a bottom surface of the drum, and a controller that is configured to control operations of the second washing apparatus, wherein the method comprises:

sequentially performing, by the second washing apparatus, a washing cycle, a rinsing cycle, and a spin-drying cycle;

determining whether bubbles have been generated in the tub during the washing cycle;

during the rinsing cycle, sequentially performing draining washing water from the tub, intermittently spinning the drum to dry laundry using centrifugal force generated by spinning of the drum, supplying wash water to the tub, and rinsing laundry in the tub; and based on a determination that bubbles have been generated in the tub during the washing cycle, performing, during the rinsing cycle, at least one operation directed to reducing bubbles by spraying water with the spray unit after draining washing water from the tub and before intermittently spinning the drum.

2. The method of claim 1, wherein performing the at least one operation directed to reducing bubbles comprises (i) adding the at least one operation directed to reducing bubbles in performing the washing cycle, the rinsing cycle, and the spin-drying cycle or (ii) replacing at least one of the washing cycle, the rinsing cycle, or the spin-drying cycle with the at least one operation directed to reducing bubbles.

3. The method of claim 2, further comprising:

controlling the drum to operate at a first rpm to perform washing in the washing cycle, wherein performing the at least one operation directed to reducing bubbles comprises controlling the drum to operate at a second rpm that is less than the first rpm.

4. The method of claim 3, wherein, in a state in which the drum rotates in a first direction at the first rpm, wash water in the tub moves upwardly along an inner circumferential surface of the tub and is introduced into the tub through the introduction port.

5. The method of claim 4, wherein, in a state in which the drum operates at the second rpm, wash water in the tub does not move.

6. The method of claim 3, wherein determining whether bubbles have been generated in the tub comprises determining whether bubbles have been generated based on a difference between a level of wash water in the tub in a state in which the drum operates at the first rpm and a reference level of wash water in the tub.

7. The method of claim 6, further comprising:

controlling the second washing apparatus to operate in the washing cycle for a first time period based on a determination that bubbles have been generated, and controlling the second washing apparatus to operate in the washing cycle for a second time period based on a determination that bubbles have not been generated, wherein the first time period is longer than the second time period.

8. The method of claim 1, wherein performing the at least one operation directed to reducing bubbles includes a bubble reduction pattern comprising:

supplying water, draining water, and rotating the drum simultaneously.

9. The method of claim 8, wherein the bubble reduction pattern further includes:

waiting, for a third time period, to stop supplying water, draining water, and rotating the drum, and draining water.

10. The method of claim 8, further comprising: repeating the bubble reduction pattern.

11. The method of claim 8, wherein performing the at least one operation directed to reducing bubbles includes a rinsing pattern comprising:

supplying water, rotating the drum, and draining water sequentially.

12. The method of claim 11, further comprising: performing the bubble reduction pattern before and after the rinsing pattern.

13. The method of claim 12, further comprising: completing the at least one operation directed to reducing bubbles after the rinsing pattern and the bubble reduction pattern are sequentially performed.

14. The method of claim 3, further comprising:

controlling the drum to operate at a third rpm to rinse laundry, wherein, in a state in which the drum operates at the third rpm, wash water in the tub moves upwardly along an inner circumferential surface of the tub and is introduced into the tub through the introduction port to wash a lower surface of the tub door.

15. The method of claim 1, wherein determining whether bubbles have been generated in the tub is performed during intermittently spinning the drum to dry laundry.

16. The method of claim 15, further comprising performing, based on a determination that bubbles have been generated, a bubble removal pattern after intermittently spinning the drum, and wherein the bubble removal pattern includes: supplying water, draining water, and rotating the drum simultaneously.

17. The method of claim 15, wherein determining whether bubbles have been generated in the tub comprises determining whether bubbles have been generated based on a value of current measured in a motor to drive the drum during intermittently spinning the drum.

18. The method of claim 1, wherein determining whether bubbles have been generated in the tub comprises determining that bubbles have been generated based on a level of wash water in the tub being greater than a reference level.

* * * * *